US007071900B2

(12) United States Patent
Ide et al.

(10) Patent No.: US 7,071,900 B2
(45) Date of Patent: Jul. 4, 2006

(54) DISPLAY PANEL DRIVING APPARATUS HAVING A STRUCTURE CAPABLE OF REDUCING POWER LOSS

(75) Inventors: Shigeo Ide, Yamanashi (JP); Takashi Iwami, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 451 days.

(21) Appl. No.: 10/283,188

(22) Filed: Oct. 30, 2002

(65) Prior Publication Data

US 2003/0085886 A1 May 8, 2003

(30) Foreign Application Priority Data

Nov. 6, 2001 (JP) ..... 2001-341086
Feb. 8, 2002 (JP) ..... 2002-032402

(51) Int. Cl.
*G09G 3/28* (2006.01)

(52) U.S. Cl. ..... 345/60; 345/68

(58) Field of Classification Search ..... 345/68, 345/204, 209, 211, 60, 66, 67, 69, 74, 76; 315/167, 169.4, 169.3; 326/95, 98, 133; 313/231.31, 231.41

See application file for complete search history.

(56) References Cited

U.S. PATENT DOCUMENTS 5,654,728 A 8/1997 Kanazawa et al.
6,111,556 A 8/2000 Moon
2004/0174356 A1* 9/2004 Ide et al. ..... 345/209

FOREIGN PATENT DOCUMENTS

EP 1 065 650 A2 1/2001
KR 1998-073575 11/1998

* cited by examiner

*Primary Examiner*—Amare Mengistu
(74) *Attorney, Agent, or Firm*—Sughrue Mion, PLLC

(57) ABSTRACT

A display panel driving circuit for driving a display panel, in which the electric power consumption at the time of the switching can be reduced. The display panel driving apparatus allows the use of a switching device of a low withstanding voltage. A transition voltage generating circuit for shifting a voltage of a DC power source of the driving apparatus is provided. A resonance relay circuit is provided for generating a pulse having a leading edge which rises gradually and a trailing edge which decreases gradually based on the transition voltage and supplying it as a drive pulse to the display panel. A plurality of resonance circuits for driving and exciting capacitive devices of the display panel are provided in a range of different driving potentials. The drive pulse having the leading edge which rises gradually and the trailing edge which decreases gradually is generated by switching each of the resonance circuits by the switching device to make them operative sequentially.

2 Claims, 21 Drawing Sheets

DISPLAY PANEL DRIVING APPARATUS HAVING A STRUCTURE CAPABLE OF REDUCING POWER LOSS

BACKGROUND OF THE INVENTION

1. Field of the Invention

The invention relates to a display panel driving apparatus for generating a drive pulse for driving a display panel having a capacitive load such as plasma display panel (hereinafter, referred to as "PDP") or electroluminescence (hereinafter, referred to as "EL").

2. Description of Related Art

Nowadays, display apparatus using a flat panel of a self light emitting type such as PDP or EL is put on the market as the so called wall-mounted TV.

FIG. 1 is a block diagram schematically showing the construction of the flat panel display apparatus.

In FIG. 1, a PDP 10 as a display panel has row electrodes $Y_1$ to $Y_n$ and $X_1$ to $X_n$ constituting row electrode pairs in which one pair of X and Y corresponds to each row (the first row to the nth row) of one screen. Further, column electrodes $Z_1$ to $Z_m$ corresponding to each column (the first column to the mth column) of one screen are formed on the PDP 10 so as to perpendicularly cross the row electrode pairs and sandwich a dielectric layer and a discharge space (not shown). One discharge cell $C_{(i, j)}$ is formed in a crossing portion of one row electrode pair (X, Y) and one column electrode Z.

First, a row electrode driving circuit 30 generates a reset pulse $RP_y$ of a positive voltage as shown in FIG. 2 and simultaneously applies it to each of the row electrodes $Y_1$ to $Y_n$. Simultaneously, a row electrode driving circuit 40 generates a reset pulse $RP_x$ of a negative voltage and simultaneously applies it to all of the row electrodes $X_1$ to $X_n$.

By the simultaneous application of those reset pulses $RP_x$ and $RP_y$, all discharge cells of the PDP 10 are discharge-excited and charged particles are generated. After the termination of the discharge, a predetermined amount of wall charges are uniformly formed in the dielectric layers of all of the discharge cells (resetting step).

After the completion of the resetting step, a column electrode driving circuit 20 generates pixel data pulses $DP_1$ to $DP_n$ according to the pixel data corresponding to each of the first row to the nth row of the screen. Those pixel data pulses are sequentially applied to the column electrodes $Z_1$ to $Z_m$ as shown in FIG. 2. The row electrode driving circuit 30 generates a scanning pulse SP of a negative voltage in accordance with the timing of application of each of the pixel data pulses $DP_1$ to $DP_n$ and sequentially applies it to the row electrodes $Y_1$ to $Y_n$ as shown in FIG. 2.

Among the discharge cells belonging to the row electrodes to which the scanning pulse SP has been applied, a discharge occurs in the discharge cells to which the pixel data pulse of the positive voltage has been further simultaneously applied, so that most of their wall charges are extinguished. On the other hand, no discharge occurs in the discharge cells to which the pixel data pulse of the positive voltage is not applied although the scanning pulse SP is applied. The wall charges remain in these discharge cells. In this way, the discharge cells whose wall charges remain become light emission discharge cells and the discharge cells whose wall charges have been extinguished become non-light emission discharge cells (addressing step).

After the completion of the addressing step, the row electrode driving circuit 30 continuously applies a sustain pulse $IP_y$ of a positive voltage to each of the row electrodes $Y_1$ to $Y_n$ as shown in FIG. 2. At the same time, the row electrode driving circuit 40 continuously applies a sustain pulse $IP_x$ of a positive voltage to each of the row electrodes $X_1$ to $X_n$ at timing deviated from applying timing of the sustain pulse $IP_y$. While the sustain pulses $IP_x$ and $IP_y$ are alternately applied, the light emission discharge cells whose wall charges remain repeat a discharge light emission and sustain a light emitting state (sustain discharging step).

A drive control circuit 50 shown in FIG. 1 generates various switching signals for generating various drive pulses as shown in FIG. 2 based on the timing of the video signal being supplied, and supplies them to each of the column electrode driving circuit 20 and the row electrode driving circuits 30 and 40. In other words, each of the column electrode driving circuit 20 and the row electrode driving circuits 30 and 40 generates the various drive pulses as shown in FIG. 2 in response to the switching signals which are supplied from the drive control circuit 50.

FIG. 3 is a diagram showing a drive pulse generating circuit which is provided in the row electrode driving circuit 30 and is operative to generate each of the reset pulse $RP_y$ and the sustain pulse $IP_y$.

In FIG. 3, a capacitor C1 whose one end is connected to the ground, that is, a PDP earth potential Vs as the earthing potential of the PDP 10 is provided for the drive pulse generating circuit.

A switching device S01 is in a disconnecting state (OFF state) while a switching signal SW01 at the logic level "0" is supplied from the drive control circuit 50. The switching device S01 is in a connecting state (ON state) when the logic level of the switching signal SW01 is equal to "1" and applies an electric potential developed at the other end of the capacitor C1 onto a line 2 via an inductor L1 and a diode D1. The capacitor C1, therefore, starts to discharge and an electric potential developed by the discharge is applied onto the line 2.

A switching device S02 is in a disconnecting state (OFF state) while a switching signal SW02 at the logic level "0" is supplied from the drive control circuit 50. The switching device S02 is in a connecting state (ON state) when the logic level of the switching signal SW02 is equal to "1" and applies an electric potential on the line 2 to the other end of the capacitor C1 via an inductor L2 and a diode D2. That is, the capacitor C1 is charged by the electric potential on the line 2.

A switching device S03 is in a disconnecting state (OFF state) while a switching signal SW03 at the logic level "0" is supplied from the drive control circuit 50. The switching device S03 is in a connecting state (ON state) when the logic level of the switching signal SW03 is equal to "1" and applies an electric potential Vc at a positive side terminal of a DC power source B1 onto the line 2. The PDP earth potential Vs is applied to a negative side terminal of the DC power source 1.

A switching device S04 is in a disconnecting state (OFF state) while a switching signal SW04 at the logic level "0" is supplied from the drive control circuit 50. The switching device S04 is in a connecting state (ON state) when the logic level of the switching signal SW04 is equal to "1" and applies the PDP earth potential Vs onto the line 2.

The line 2 is connected to a row electrode Y of the PDP 10 having a capacitive component $C_0$. Thus, in the row electrode driving circuit 30, the circuit shown in FIG. 3 is provided for each of n channels corresponding to the row electrodes $Y_1$ to $Y_n$.

FIG. 4 is a diagram showing the timing of each of the switching signals SW01 to SW04 which are supplied from the drive control circuit 50 to the row electrode driving circuit 30 shown in FIG. 3 in order to generate the sustain pulse $IP_y$ as shown in FIG. 2 on the line 2.

As shown in FIG. 4, first, the switching signal SW04 among the switching signals SW01 to SW04 is only at the logic level "1", so the switching device S04 takes the ON state and the PDP earth potential Vs is applied on the line 2. Therefore, during this period of time, the electric potential on the line 2 is equal to the PDP earth potential Vs, that is, 0 [V].

Subsequently, when the switching signal SW04 is switched to the logic level "0" and the switching signal SW01 is switched to the logic level "1", only the switching device S01 takes the ON state and the charges accumulated in the capacitor C1 are discharged. A current, therefore, flows transiently in the inductor L1 in a form as shown in FIG. 4. The current flows into the PDP 10 via the diode D1, switching device S01, and line 2 and the capacitive component $C_0$ of the PDP 10 is charged, so that the electric potential on the line 2 rises gradually as shown in FIG. 4.

Subsequently, when the switching signal SW01 is switched to the logic level "0" and the switching signal SW03 is switched to the logic level "1", only the switching device S03 takes the ON state and the electric potential Vc at the positive side terminal of the DC power source B1 is applied onto the line 2. During the period of time, therefore, the electric potential on the line 2 is fixed to Vc as shown in FIG. 4.

Subsequently, when the switching signal SW02 is switched to the logic level "1" and the switching signal SW03 is switched to the logic level "0", only the switching device S02 takes the ON state and a negative current flows transiently in the inductor L2 in a form as shown in FIG. 4. That is, the capacitive component $C_0$ of the PDP 10 which has been charged as mentioned above is discharged and the current flows into the capacitor C1 via the line 2, inductor L2, diode D2, and switching device S02 and is collected. The electric potential on the line 2, therefore, decreases gradually as shown in FIG. 4.

By the operation as mentioned above, the sustain pulse $IP_y$ of the positive voltage as shown in FIG. 4 is applied onto the line 2.

As for the voltage which is used when the capacitive load such as a PDP is driven, a relatively high voltage value in a range from tens of volts to a hundred and tens of volts is generally used. In the construction of the conventional driving circuit shown in FIG. 3, therefore, there is a problem that a resonance current flowing at the time of charging or discharging the capacitive load also increases and a large electric power loss occurs.

A withstanding voltage of each switching device included in the driving circuit of each of the row electrodes and the column electrodes is determined by the maximum value of a drive pulse voltage which is applied to each device. To assure a withstanding voltage enough for the high voltage mentioned above, therefore, it is necessary to use the switching device of a high withstanding voltage. Use of the switching device of the high withstanding voltage becomes an obstacle to the realization of low costs and miniaturization of the driving circuit.

FIGS. 5 and 6 show examples of a display panel driving circuit which is provided in the electrode driving circuit and generates various drive pulses such as reset pulse $RP_y$ and sustain pulse $IP_y$. Those circuits generate the drive pulses by using the charge/discharge of the capacitor due to the resonance of an LC circuit comprising the inductor and the capacitor. That is, in consideration of a point that each discharge cell of the PDP 10 is a capacitive load, a resonance circuit is formed by combining the inductor as an inductive device and the capacitor for collecting an electric power to the discharge cell. The resonance circuit is excited at predetermined timing by using a switching device such as an FET, thereby generating a desired pulse.

The circuit of FIG. 5 has conventionally widely been used as a display panel driving circuit and is referred to as a "single-stage resonance circuit" hereinbelow for convenience of explanation. The circuit shown in FIG. 6 intends to reduce the withstanding voltage of the device used in the single-stage resonance circuit and is similarly referred to as a "double resonance circuit" below.

As for the voltage which is used when the capacitive load such as a PDP is driven by the resonance current, a relatively high voltage value in a range from tens of volts to a hundred and tens of volts is generally used. In the conventional display panel driving circuits shown in FIGS. 5 and 6, therefore, there is a problem such that a resonance current flowing at the time of charging or discharging the capacitive load also increases and a large electric power loss occurs when the load is driven.

Particularly, in the double resonance circuit shown in FIG. 6, although the withstanding voltage of the device used in the circuit is reduced more than that in the single-stage resonance circuit, there is a chance of occurrence of a problem as described below. That is, the double resonance circuit has a construction such that a potential transition circuit comprising the switching device, capacitor, and the like is added to the single-stage resonance circuit of FIG. 5 in order to raise the electric potential which is applied to the resonance circuit step by step. The resonance current, therefore, passes through a switching device SW11 or SW12 constituting the potential transition circuit and a surplus electric power loss due to an ON resistance of the device is caused. A parasitic capacitance Ck is caused between electric potential lines (OUTa and OUTb in FIG. 6) on the positive and negative sides of a pulse output and the ground or a power source. Since the parasitic capacitance Ck is excited by the power voltage V/2, there also is a chance that a power loss $$n \times Ck \times (V/2)^2$$

further occurs. In this expression, n indicates the number of repetition times in the unit time of the drive pulse.

OBJECTS AND SUMMARY OF THE INVENTION

The invention has been made in view of the above-described problems and it is an object of the invention to provide a display panel driving apparatus in which the electric power consumption can be reduced. It is another object of the invention to provide a display panel driving apparatus in which a switching device of a low withstanding voltage can be used, so that the size of the apparatus may be reduced. It is a further object of the invention to provide a display panel driving apparatus which can be produced at low cost.

According to the invention, there is provided a display panel driving apparatus for driving a display panel having a row electrode group, a column electrode group arranged so as to cross the row electrode group, and capacitive light emitting devices each of which is arranged at each of crossing points of the row electrode group and the column electrode group, wherein a drive pulse is applied to each of the capacitive light emitting devices via an output terminal when driving the display panel, the apparatus comprising:

a DC power source for sustaining a predetermined voltage;

a transition voltage generating circuit for generating a transition voltage which rises and trails by charging and discharging charges from the DC power source; and a resonance relay circuit for generating a pulse having a leading edge which rises gradually and a trailing edge which trails gradually as a drive pulse from the output terminal based on the transition voltage.

According to the invention, there is provided a display panel driving circuit for driving a display panel having a row electrode group, a column electrode group arranged so as to cross the row electrode group, and capacitive light emitting devices each of which is arranged at each of crossing points of the row electrode group and the column electrode group, wherein a drive pulse is supplied to each of the capacitive light emitting devices via an output terminal when driving the display panel, the apparatus comprising:

a reference potential generating circuit for generating a plurality of reference potentials in order from a high potential;

a resonance circuit which is connected to the capacitive light emitting devices via the output terminal, forms a resonance circuit, and generates a plurality of resonance voltages which rise and decrease at different timings from each of the plurality of reference potentials onto the output terminal; and a clamping circuit for clamping a peak voltage in each of the resonance voltages to one of the plurality of reference potentials and generating a pulse which sets a highest value of the plurality of reference potentials to its amplitude and has a leading edge which rises gradually and a trailing edge which decreases gradually as a drive pulse onto the output terminal.

DETAILED DESCRIPTION OF THE PREFERRED EMBODIMENTS

Figure 7:
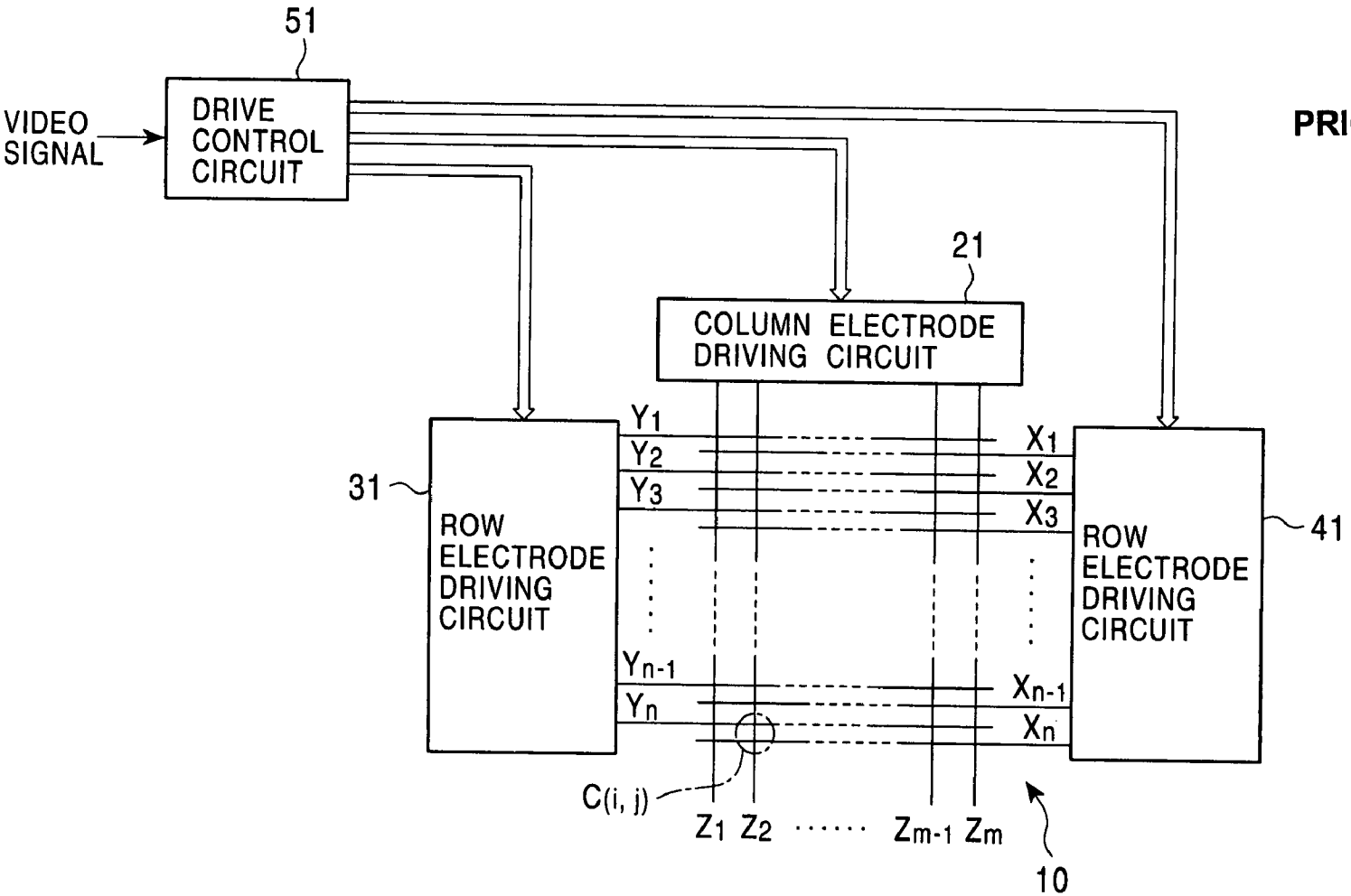
FIG. 7 PRIOR ART
FIG. 7 is a diagram schematically showing the construction of a PDP display apparatus having a driving apparatus of the invention.

FIG. 7 is a diagram showing the construction of a display apparatus having a driving apparatus of the display panel according to the invention.

In FIG. 7, the PDP 10 as a display panel has the row electrodes $Y_1$ to $Y_n$ and $X_1$ to $X_n$ constituting row electrode pairs in which one pair of X and Y corresponds to each row (the first row to the nth row) of one screen. Further, the column electrodes $Z_1$ to $Z_m$ correspond to each column (the first column to the mth column) of one screen are formed on the PDP 10 so as to perpendicularly cross the row electrode pairs and sandwich a dielectric layer and a discharge space (not shown). One discharge cell $C_{(i,j)}$ is formed in a crossing portion of one row electrode pair (X, Y) and one column electrode Z.

Figure 1:
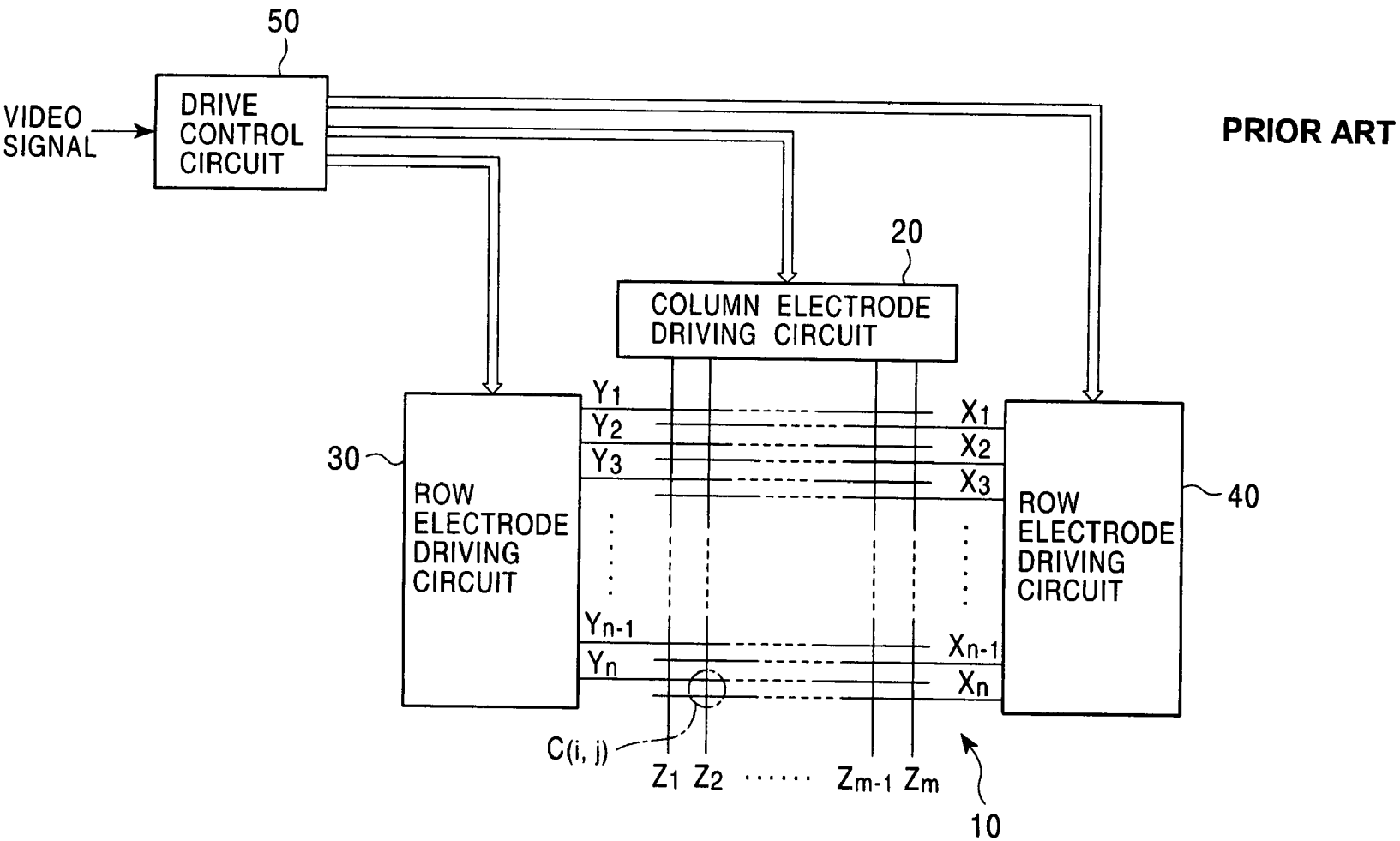
FIG. 1 is a diagram showing a schematic construction of a conventional PDP display apparatus.
Figure 2:
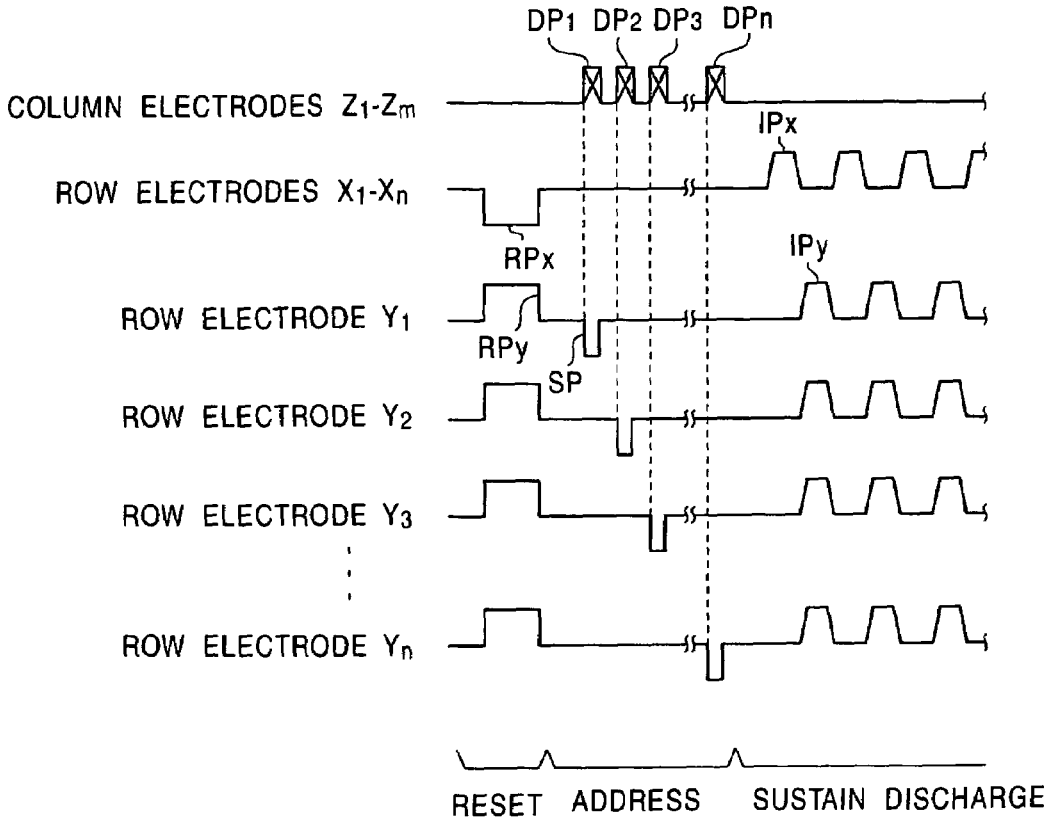
FIG. 2 PRIOR ART
FIG. 2 is a diagram showing applying timing of various drive pulses in the apparatus of FIG. 1.

First, a row electrode driving circuit 31 generates the reset pulse $RP_y$ of the positive voltage as shown in FIG. 2, the scanning pulse SP of the negative voltage, and the sustain pulse $IP_y$ and applies them to each of the row electrodes $Y_1$ to $Y_n$ at the timing shown in FIG. 2. A row electrode driving circuit 41 generates the reset pulse $RP_x$ of the negative voltage as shown in FIG. 2 and the sustain pulse $IP_x$ of the positive voltage and applies them to each of the row electrodes $X_1$ to $X_n$ at the timing shown in FIG. 2.

A column electrode driving circuit 21 generates the pixel data pulses $DP_1$ to $DP_n$ according to the pixel data corresponding to each of the first row to the nth row of the screen. Those pixel data pulses are sequentially applied to the column electrodes $Z_1$ to $Z_m$ as shown in FIG. 2.

A drive control circuit 51 generates various switching signals for generating various drive pulses as shown in FIG. 2 based on the supplied video signal and supplies them to each of the column electrode driving circuit 21 and the row electrode driving circuits 31 and 41.

As shown in one of FIGS. 8, 10, and 12, which will be explained hereinlater, a pulse generating circuit as a display panel driving apparatus according to the invention is provided in each of the row electrode driving circuits 31, the row electrode driving circuits 41, and the column electrode driving circuit 21.

Figure 8:
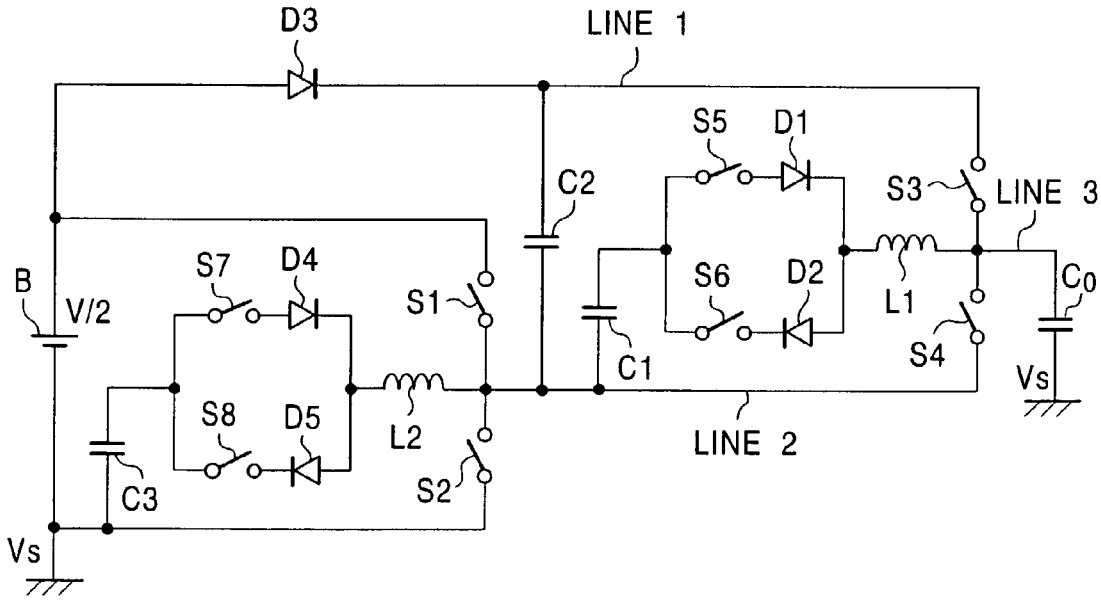
FIG. 8 is a diagram showing the first embodiment of a pulse generating circuit as a driving apparatus based on the invention.

FIG. 8 shows the first embodiment of the pulse generating circuit according to the invention and the construction of the pulse generating circuit will be described hereinbelow.

In FIG. 8, a negative side terminal of a DC power source B for generating a DC voltage (V/2) is connected to the ground, that is, to the PDP earth potential Vs as an earth potential of the PDP 10. A positive side terminal of the DC power source B is connected to a line 1 via a diode D3.

The line 1 is connected via a switching device S3 to a line 3 also serving as an output terminal which reaches each electrode (row electrode or column electrode) of the PDP 10. The capacitive component $C_0$ of the PDP 10 is connected to the line 3. An output driver circuit can be also inserted as necessary onto a path which starts from the line 3 and reaches the capacitive component $C_0$.

A cathode of the diode D3 is connected to the line 2 via a capacitor C2. The line 2 is further connected to the line 3 via a switching device S4.

The line 2 is connected to the line 3 via the capacitor C1, a diode parallel circuit 1, and the inductor L1. The diode parallel circuit 1 denotes a parallel circuit of a series branch of the diode D1 and a switching device S5 and a series branch of the diode D2 and a switching device S6.

The positive side terminal of the DC power source B is connected to an anode of the diode D3 and connected to the line 2 via a switching device S1.

The negative side terminal of the DC power source B is likewise connected to the line 2 via a switching device S2 and, at the same time, connected to the line 2 via a capacitor C3, a diode parallel circuit 2, and the inductor L2. The diode parallel circuit 2 denotes a parallel circuit of a series branch of a diode D4 and a switching device S7 and a series branch of a diode D5 and a switching device S8.

In the embodiment, a circuit constituted by the capacitor C1, diode parallel circuit 1, and inductor L1 forms a first resonance circuit, and a circuit constituted by the capacitor C3, diode parallel circuit 2, and inductor L2 forms a second resonance circuit.

Subsequently, the operation of the pulse generating circuit of the construction mentioned above will be described with reference to the circuit diagram of FIG. 8 and an operation time chart of the circuit shown in FIG. 9.

ON/OFF states of all of the switching devices S1 to S8 included in the circuit are controlled by the logic levels of switching signals SW1 to SW8 which are supplied from the drive control circuit 51 shown in FIG. 7. To avoid a redundant disclosure explanation, however, in the following description, a disclosure regarding each of the switching signals which are supplied from the drive control circuit 51 is omitted and only changes of the ON/OFF states of the switching devices S1 to S8 are time-sequentially disclosed.

In the following description, it is assumed that the switching devices S1 to S8 are merely shown by S1 to S8 and other devices such as capacitor C1 and inductor L1 are also similarly shown by only reference characters such as C1 and L1.

Figure 9:
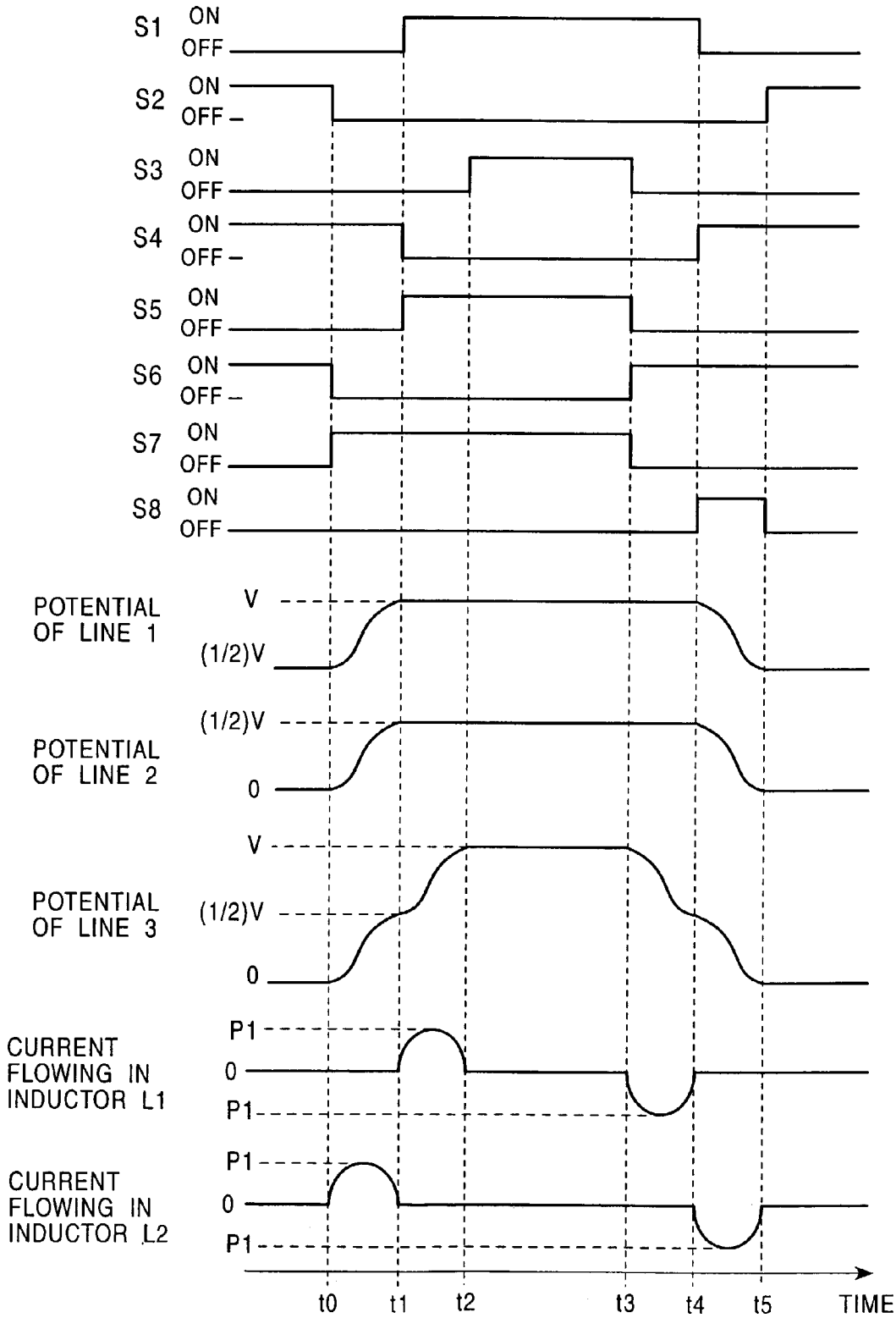
FIG. 9 is a diagram showing an operation time chart of the pulse generating circuit shown in FIG. 8.

First, at a point just before time point to shown in the time chart of FIG. 9, S1, S3, S5, S7, and S8 are OFF and S2, S4, and S6 are ON, respectively. The line 1, therefore, is connected to the positive side terminal of the DC power source B via the diode D3 and its electric potential is equal to (½)V. The lines 2 and 3 are connected to the earth potential Vs via S2 and S4 and their electric potentials are equal to the earth potential Vs of the PDP, that is, 0 [V]. Naturally, C2 connected between the lines 1 and 2 has, consequently, been charged to the electric potential of (½)V.

In the embodiment, it is assumed that C1 and C3 have been charged to an electric potential of (¼)V by means (not shown) at the time of turn-on of a power source of the apparatus.

As shown in FIG. 9, S2 and S6 are turned off and S7 is turned on at time point t0, a path of C3→S7→D4→L2 is formed in the second resonance circuit and the charges charged in C3 flow into C0 via the lines 2 and 3. At this time, since the current flowing in L2 is a resonance current according to the second resonance circuit, as shown in FIG. 9, it increases gradually from ON time point t0 of S7, becomes a positive peak value P1, and after that, decreases gradually.

By the accumulation of the charges into C0, the electric potential of the line 2 (line 3) also increases gradually from the earth potential 0 [V]. Since the electric potential of the line 2 is also equal to a bias potential, the electric potential on the line 1 side of C2 also rises gradually from (½)V serving as an initial charge potential of C2.

As shown in FIG. 9, the electric potential of the line 2 (line 3) rises gradually from 0 [V] at time point t0 and becomes an electric potential of almost (½)V at time point t1 when the resonance current flowing in L2 decreases and becomes 0. The electric potential mentioned above is caused by a resonance phenomenon due to the second resonance circuit and is equal to a value higher than the initial charge potential (¼)V in C3.

At time point t1 when the electric potential of the line 1 is almost equal to V and the electric potentials of the lines 2 and 3 are almost equal to (½)V, S1 is turned on, S4 is turned off, the line 2 is directly connected to the positive terminal side of the DC power source B, and the electric potential of the line 2 is clamped to (½)V as an electric potential of the DC power source B. Since a bias electric potential of C2 is equal to (½)V, the electric potential of the line 1 to which the other end of C2 is connected becomes a maximum electric potential V because the bias electric potential (½)V is added to the conventional charge potential (½)V of C2.

Further, also with respect to C1, the bias electric potential (½)V of the line 2 is added to the initial charge potential (¼)V, so that the electric potential of C1 in the first resonance circuit rises to (¾)V.

Since S5 is turned on at time point t1, a path of C1→S5→D1→L1 in the first resonance circuit is formed. In association with the potential increase in C1 mentioned above, based on the charges accumulated in C1 instead of C3 in the second resonance circuit so far, the resonance current starts to flow in the capacitive component $C_0$ of the PDP 10 from the first resonance circuit via the line 3.

In the circuit shown in FIG. 8, since circuit constants of the first and second resonance circuits are set to be equal as an embodiment, as shown in FIG. 9, a resonance current flowing in L1 for a period of time between time points t1 and t2 shows a change similar to that of a resonance current flowing in L2 for a period of time between time points t0 and t1.

In association with the accumulation of the charges into C0, the electric potential of the line 3 starts to increase gradually from (½)V. Since S3 is turned on at time point t2 when the electric potential of the line 3 is almost equal to V, the electric potential of the line 3 is clamped to the electric potential of the line 1, that is, the maximum electric potential V.

After that, S3, S5, and S7 are turned off and s6 is turned on at time point t3. A path of L1→D2→S6→C1 is, therefore, newly formed in the first resonance circuit in place of the foregoing path and the charges accumulated in the capacitive component $C_0$ of the PDP 10 are discharged to C1 via the above new path. The resonance current as shown in FIG. 9 flows in L1 via the line 3 by the discharge. The electric potential of the line 3 in which the clamping of the maximum electric potential V has been released by the turn-off of S3 decreases gradually as shown in the diagram.

Since the direction of the resonance current at this time is opposite to that upon increase in electric potential of the line 3 (time point t1 to t2), the peak P1 of the resonance current flowing in L1 appears on the negative side as shown in FIG. 9 when it is assumed that the case of time point t1 to t2 is set to be positive.

S1 is turned off and S4 and S8 are turned on at time point t4 when the electric potential of the line 3 is almost equal to (½)V. In the second resonance circuit, thus, a path of L2→D5→S8→C3 is validated and as shown in FIG. 9, the resonance current starts to flow into the second resonance circuit from C0 via the lines 3 and 2. Naturally, the direction of the resonance current in this case is also opposite to that upon increase in electric potential (time point t0 to t1) mentioned above.

In association with it, the electric potentials of the lines 3 and 2 decrease gradually from (½)V and, at the same time, the electric potential of the line 1 also decreases gradually. At time point t5 when the electric potentials of the lines 2 and 3 are almost equal to 0 [V], S2 is turned on, S8 is turned off, the electric potentials of the lines 2 and 3 are clamped to the earth potential Vs of the PDP, that is 0 [V].

At time point t5, the diode D3 is made conductive, the charges in C2 are supplemented by the DC power source B, and the electric potential of the line 1 is set to (½)V.

By the operation described above, a pulse waveform shown in FIG. 9 is generated on the line 3 in FIG. 8 and the pulse is supplied as each pulse such as sustain pulse $IP_x$ or pixel data pulse DP to the PDP 10 from the line 3 also serving as an output terminal of the pulse generating circuit.

As will be also obviously understood from the above description, a voltage range where the switching devices S1 to S8 included in the circuit of the embodiment execute the switching operation is limited to [0⇆(½)V] or [(½)V⇆V]. It is, therefore, sufficient that all of the withstanding voltages of the switching devices in the circuit are set to (½)V and it is sufficient that they can be set to the half of the withstanding voltage in the conventional circuit. Miniaturization and low costs of the switching devices which are used in the pulse generating circuit are, thus, accomplished.

Naturally, it is also sufficient that the maximum voltage of the DC power source B which should be provided as a pulse generating circuit can be set to (½)V as a value which is equal to the half of the conventional one.

Figure 3:
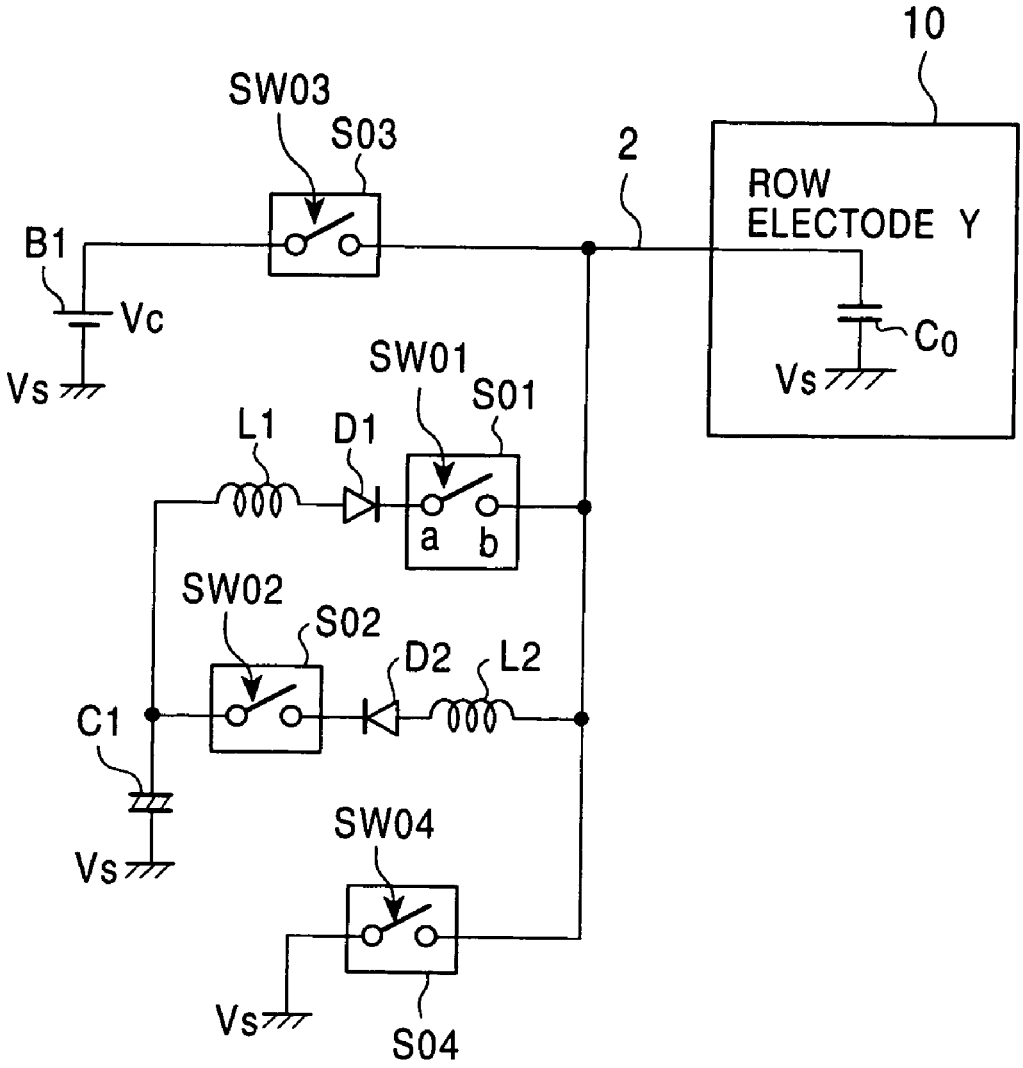
PRIOR ART FIG. 3
FIG. 3 is a diagram showing a drive pulse generating circuit provided for a row electrode driving circuit 30.
Figure 4:
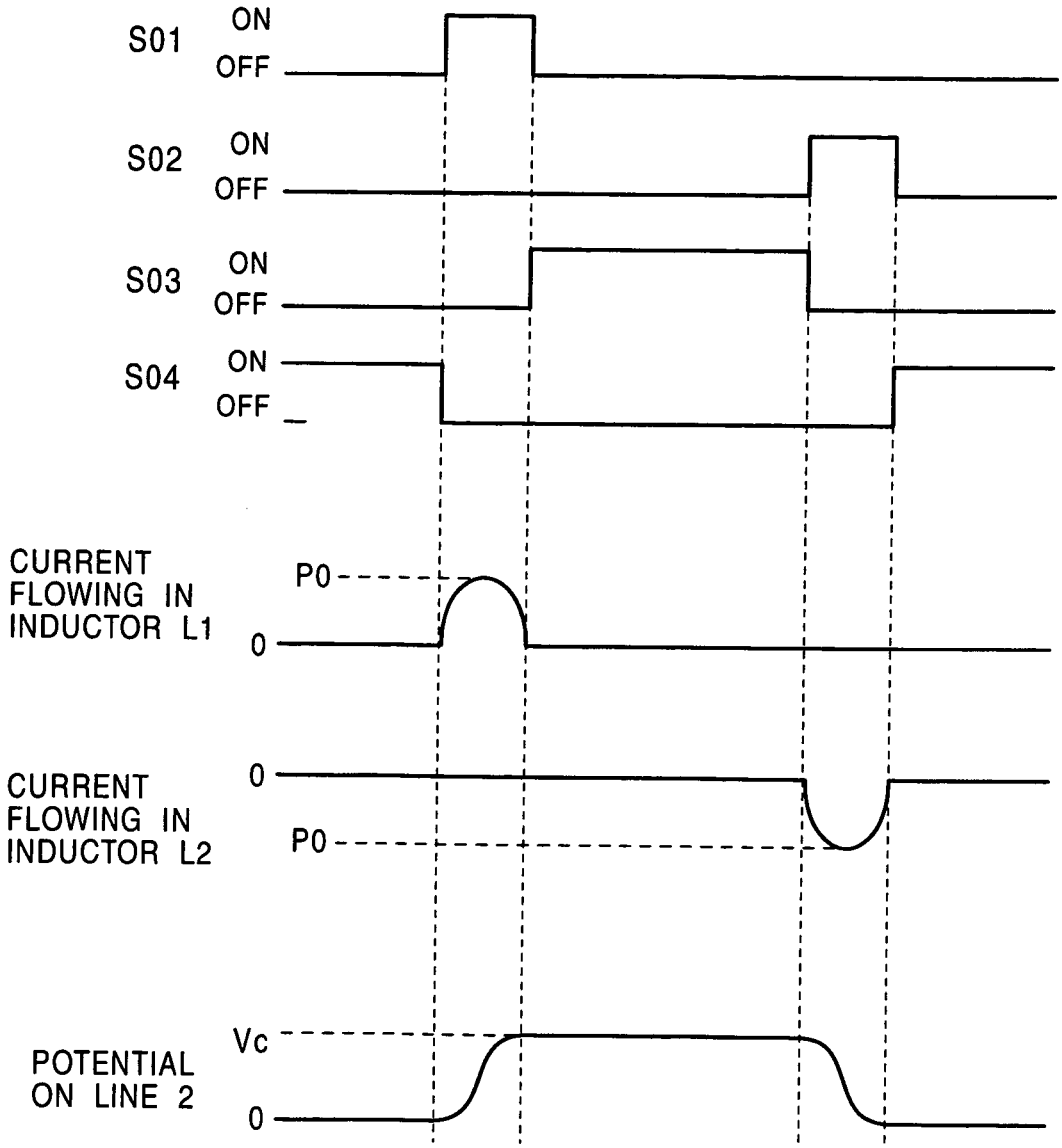
FIG. 4 PRIOR ART
FIG. 4 is a diagram showing an operation time chart of the drive pulse generating circuit shown in FIG. 3.
Figure 5:
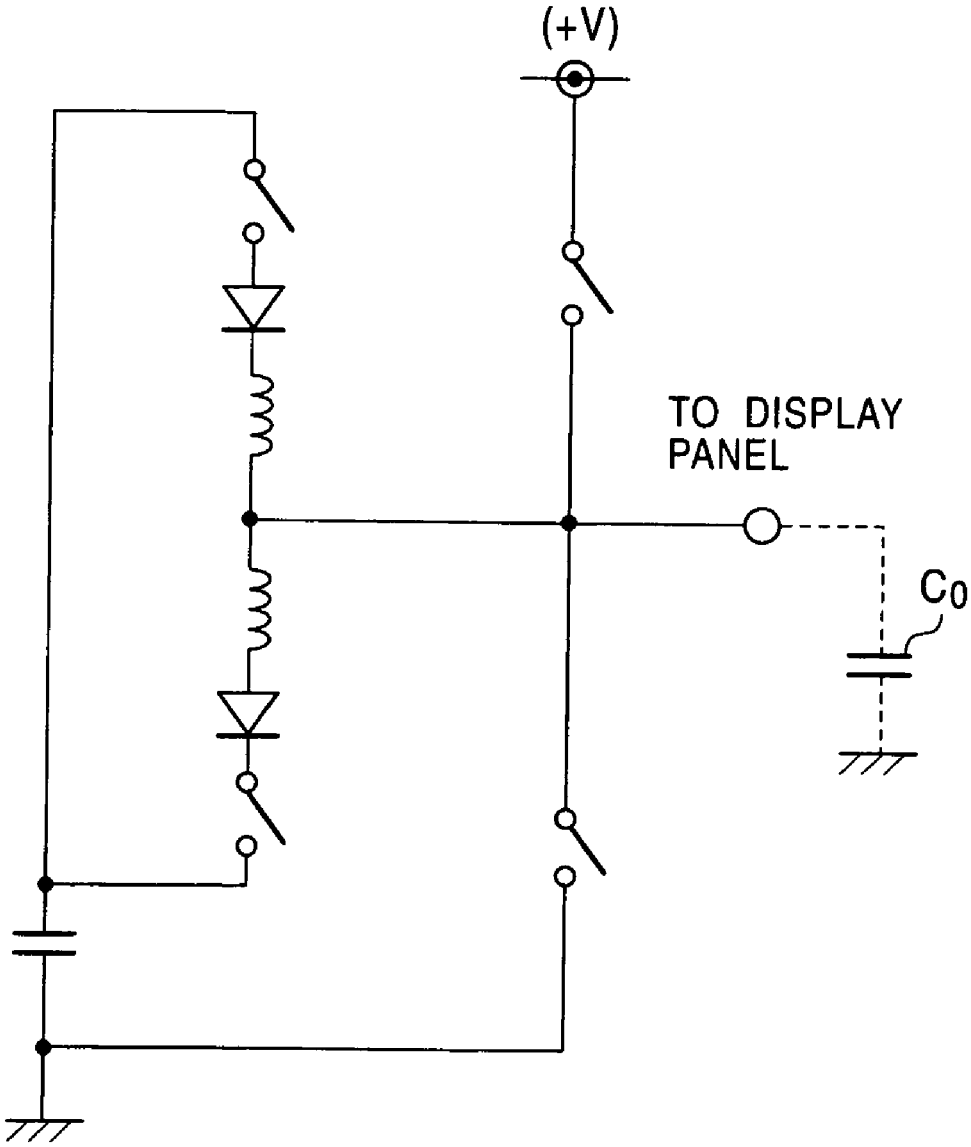
FIG. 5 PRIOR ART
FIG. 5 is a circuit diagram showing the construction of a conventional display panel driving circuit (single-stage resonance circuit)

Further, if electric power consumption in the conventional driving circuit shown in FIG. 3 is assumed to be W0, it can be expressed by $$W0=C_0\cdot V^2\cdot f \tag{1}$$

where, $C_0$: capacitive component of the PDP 10

V: voltage of the DC power source f: driving frequency

In the driving circuit of the embodiment shown in FIG. 8, since the power voltage is equal to ½ of that of the conventional circuit and the driving frequency is equal to twice as large as that of the conventional circuit, if electric power consumption in the driving circuit is assumed to be W1, it can be expressed by $$W1=C_0\cdot(V/2)^2\cdot(2f)=(1/2)\cdot C_0\cdot V^2\cdot f \tag{2}$$

It will be understood that W1 is almost equal to the half of the electric power consumption W0 in the conventional circuit.

Subsequently, the second embodiment of the pulse generating circuit according to the invention will be described. FIG. 10 shows the construction of the circuit. The construction of the circuit based on the embodiment will be described hereinbelow with reference to the drawing.

Figure 10:
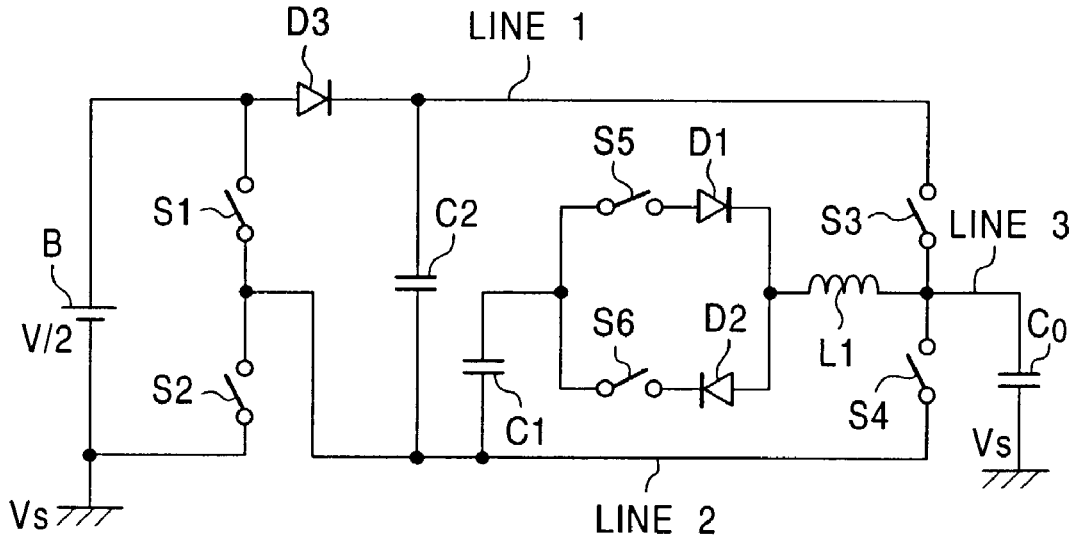
FIG. 10 is a diagram showing the second embodiment of a pulse generating circuit as a driving apparatus based on the invention.

In FIG. 10, the negative side terminal of the DC power source B for generating the DC voltage (V/2) is connected to the ground, that is, to the PDP earth potential Vs as an earth potential of the PDP 10. The positive side terminal of the DC power source B is connected to the line 1 via the diode D3.

The line 1 is connected to the line 3 as an output terminal which starts from the circuit and reaches each electrode (row electrode or column electrode) of the PDP 10 via the switching device S3. The capacitive component $C_0$ of the PDP 10 is connected to the line 3. An output driver circuit can be also inserted onto the path starting from the line 3 and reaching the capacitive component $C_0$ of the PDP 10 as necessary.

The cathode of the diode D3 is connected to the line 2 via the capacitor C2. The line 2 is further connected to the line 3 via the switching device S4.

The line 2 is likewise connected to the line 3 via the capacitor C1, diode parallel circuit, and inductor L1. The diode parallel circuit denotes a parallel circuit of a series branch of the diode D1 and the switching device S5 and a series branch of the diode D2 and the switching device S6.

A series branch of the switching devices S1 and S2 is connected between the positive side terminal and negative side terminal of the DC power source B. A middle point of the series branch is connected to the line 2.

Subsequently, the operation of the pulse generating circuit with the above construction will be described with reference to the circuit diagram of FIG. 10 and an operation time chart shown in FIG. 11 in the circuit.

The ON/OFF states of all of the switching devices S1 to S6 included in the circuit are controlled by the logic levels of switching signals SW1 to SW6 which are supplied from the drive control circuit 51 shown in FIG. 7. In the following description, however, in order to simplify the disclosure, an explanation regarding the switching signals which are supplied from the drive control circuit 51 is omitted and it is assumed that only changes of the ON/OFF states of the switching devices S1 to S6 are time-sequentially disclosed.

In the following description, it is assumed that the switching devices S1 to S6 are merely shown by S1 to S6 and other devices such as capacitor C1 and inductor L1 are also similarly shown by only reference characters such as C1 and L1.

Figure 11:
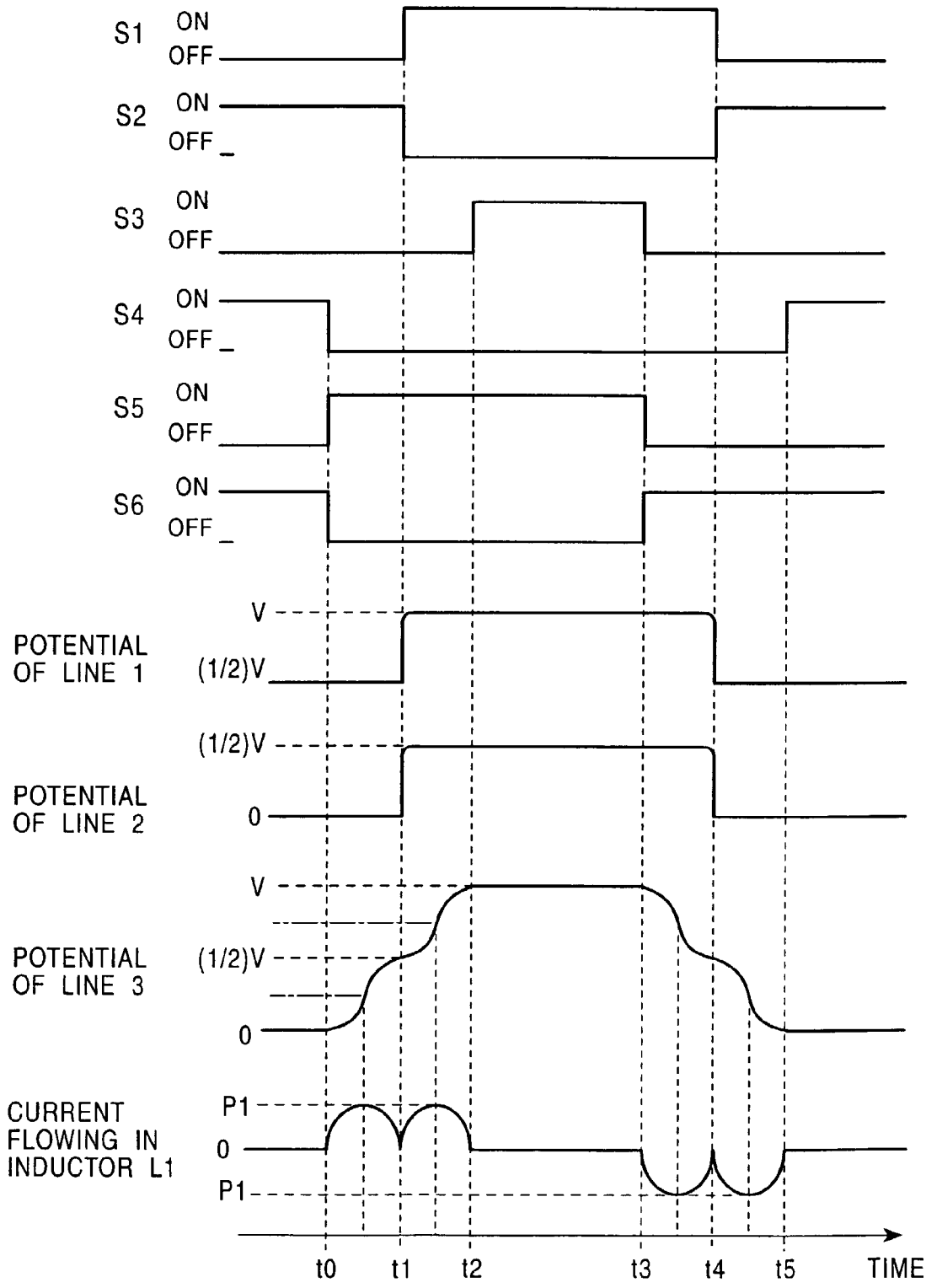
FIG. 11 is a diagram showing an operation time chart of the pulse generating circuit shown in FIG. 10.

First, at a point just before time point to shown in the time chart of FIG. 11, S1, S3, and S5 are OFF and S2, S4, and S6 are ON, respectively. The line 1, therefore, is connected to the positive side terminal of the DC power source B via the diode D3 and the electric potential of the line 1 is equal to (½)V.

Similarly, the lines 2 and 3 are connected to the earth potential Vs via S2 and S4 and their electric potentials are equal to the earth potential Vs of the PDP, that is, 0 [V]. C2 connected between the lines 1 and 2 has, consequently, been charged to the electric potential of (½)V. In the embodiment, it is assumed that C1 has been charged to the electric potential of (¼)V by the means (not shown) at the time of turn-on of the power source of the apparatus.

When S4 is turned off and S5 is turned on at time point t0, since a path of C1→S5→D1→L1 is formed, the charges charged in C1 flow into C0 via the line 3. Since the current flowing in L1 is a resonance current which flows from the resonance circuit into the capacitive component $C_0$ of the PDP 10, as shown in FIG. 11, it increases gradually from ON start time point t0 of S5 and, when the resonance current reaches the positive peak current value P1, it decreases gradually after that.

The electric potential of the line 3 increases gradually from 0 [V] at time point t0 and is almost equal to the electric potential of (½)V at time point t1 when the current flowing in L1 decreases and is equal to 0. The resonance transition of the first time (potential change on the line 3 between time points t0 and t1) is finished. The electric potential due to the resonance transition is caused by the resonance phenomenon of the resonance circuit including L1 and is equal to a value higher than the electric potential (¼)V charged in C1 at the first time.

S1 is turned on and S2 is turned off at time point t1 when the electric potential of the line 3 is almost equal to (½)V, the line 2 is switched from the earth potential to the positive terminal side of the DC power source B and the electric potential of the line 2 is clamped to the electric potential of (½)V of the DC power source B. The electric potential of the line 1, thus, rises to the maximum potential V since the bias potential (½)V of the line 2 is added to the charge potential (½)V of C2.

Also in the resonance circuit, the bias potential (½)V of the line 2 is added to the conventional charge potential (¼)V of C1 and the electric potential of C1 rises to (¾)V. By the increase in electric potential, the discharge from C1 to C0 is restarted. The resonance transition of the second time occurs subsequently to the resonance transition of the first time and the electric potential of the line 3 continues to rise.

At time point t2 when the electric potential of the line 3 is almost equal to V, S3 is turned on and the electric potential of the line 3 is clamped to the maximum potential V as an electric potential of the line 1.

After that, S3 and S5 are turned off and S6 is turned on at time point t3. The clamping of the maximum potential V in the line 3 is, therefore, released and, at the same time, the conventional resonance current path via S5→D1→L1 is also disconnected.

By the above switching operation, a current path via L1→D2→S6→C1 is newly formed and the charges charged in the capacitive component $C_0$ of the PDP 10 are now discharged toward C1. That is, the resonance current starts to flow again via the line 3 and the charges accumulated in C0 are collected into C1. Since the resonance current at this time flows in the direction from C0 to C1, when the direction of the current between time points t0 and t2 mentioned above is assumed to be positive, the direction of the resonance current at this time is the opposite direction as shown in FIG. 11, that is, the resonance current at this time can be expressed as a resonance current in the negative direction. When the resonance current starts to flow, the charges accumulated in C0 decrease gradually. In association with it, the electric potential of the line 3 also decreases gradually.

At time point t4 when the electric potential of the line 3 decreases to almost (½)V, S1 is now turned off and S2 is turned on. The diode D3 is, thus, made conductive, the charges in C2 are supplemented by the DC power source B, the electric potential of the line 1 is equal to (½)V as an electric potential of the DC power source B, and the electric potential of the line 2 is equal to the earth potential Vs of the PDP, that is 0 [V]. Since the line 2 is connected to the ground, the bias potential applied to C1 is equal to 0, so that the electric potential of C1 to the line 3 decreases to the initial charge potential (¼)V of C1. At time point t4 when the electric potential of the line 3 is almost equal to the electric potential of (½)V, the resonance transition of the third time (potential change on the line 3 between time points t3 and t4) is finished.

In association with the decrease in electric potential of C1, the discharge from C0 to C1 is restarted. The resonance transition of the fourth time occurs subsequently to the resonance transition of the third time and the electric potential of the line 3 further decreases as shown in FIG. 11. At time point t5 when the electric potential of the line 3 is almost equal to 0 [V], S4 is turned on and the electric potential of the line 3 is clamped to the earth potential Vs of the PDP, that is 0 [V].

By the operation described above, a pulse waveform shown in FIG. 11 is generated onto the line 3 in FIG. 10 and the pulse is supplied as each pulse such as sustain pulse $IP_x$ or pixel data pulse DP to the PDP 10 via the line 3 also serving as an output terminal of the present circuit.

As will be also obviously understood from the above description, a voltage range where the switching devices S1 to S6 included in the circuit of the embodiment execute the switching operation is limited to [0⇆(½)V] or [(½)V⇆V]. That is, it is sufficient that all of the withstanding voltages of the switching devices in the circuit are set to (½)V and it is sufficient that they can be set to the half of the withstanding voltage in the conventional circuit. Miniaturization and low costs of the switching devices which are used in the pulse generating circuit are, consequently, accomplished.

Naturally, it is also sufficient that the maximum voltage of the DC power source B which should be provided as a pulse generating circuit can be set to (½)V as a value which is equal to the half of the conventional one.

Further, if electric power consumption in the conventional driving circuit shown in FIG. 3 is assumed to be W0, it can be expressed by $$W0=C_0\cdot V^2\cdot f \tag{3}$$

where, $C_0$: capacitive component of the PDP 10

V: voltage of the DC power source f: driving frequency

In the driving circuit of the embodiment shown in FIG. 10, since the power voltage is equal to ½ of that of the conventional circuit and the driving frequency is equal to twice as large as that of the conventional circuit, if electric power consumption in the driving circuit is assumed to be W2, it can be expressed by $$W2=C_0\cdot(V/2)^2\cdot(2f)=(1/2)\cdot C_0V^2\cdot f \tag{4}$$

It will be understood that W2 is almost equal to the half of the electric power consumption W0 in the conventional circuit.

In the present embodiment, since it is sufficient to use one set of resonance circuits included in the pulse generating circuit as compared with that in the foregoing first embodiment, the reduction of the number of circuit devices and the reduction in costs can be realized.

Subsequently, the third embodiment of a pulse generating circuit as a driving apparatus according to the invention will be described.

First, the construction of the pulse generating circuit according to the third embodiment will be described with reference to a circuit diagram shown in FIG. 12.

Figure 12:
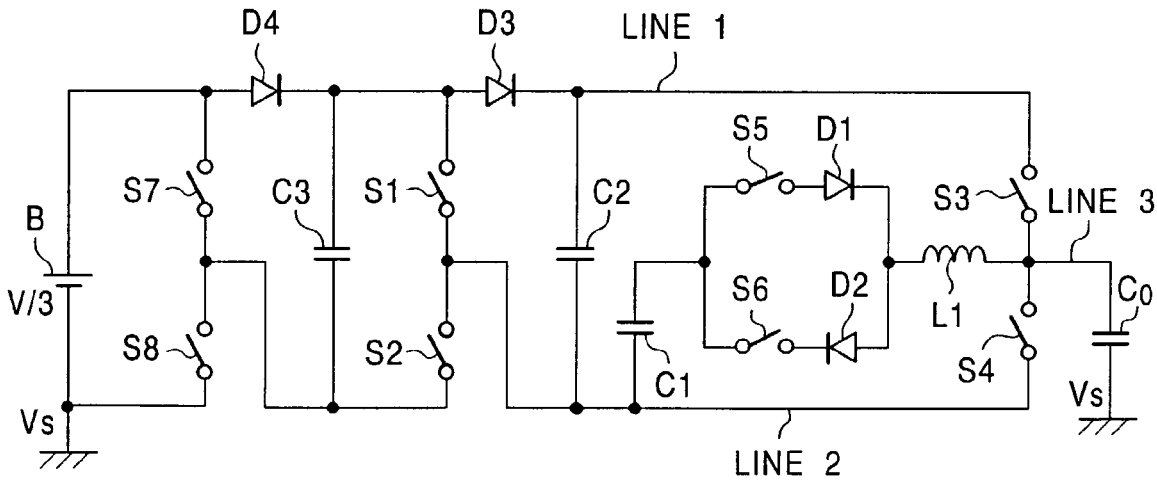
FIG. 12 is a diagram showing the third embodiment of a pulse generating circuit as a driving apparatus based on the invention.

In FIG. 12, the negative side terminal of the DC power source B for generating a DC voltage (V/3) is connected to the PDP earth potential Vs as an earth potential of the PDP 10. The positive side terminal of the DC power source B is connected to the line 1 via the diodes D4 and D3.

The line 1 is connected to the line 3 as an output terminal which reaches each electrode (row electrode or column electrode) of the PDP 10 via the switching device S3. The capacitive component $C_0$ of the PDP 10 is connected to the line 3. An output driver circuit can be also inserted onto the path starting from the line 3 and reaching the capacitive component $C_0$ of the PDP 10 as necessary.

The line 3 is connected to the line 2 via the inductor L1, diode parallel circuit, and capacitor C1. The diode parallel circuit denotes a parallel circuit of a series branch of the diode D1 and the switching device S5 and a series branch of the diode D2 and the switching device S6. In the embodiment, the resonance circuit is constituted by the inductor L1, diode parallel circuit, capacitor C1, and capacitive component $C_0$ of the PDP 10. The line 3 is further connected to the line 2 via the switching device S4.

One end of the capacitor C2 is connected to the cathode of the diode D3. One end of a series branch of the switching devices S1 and S2 is connected to the anode of the diode D3. Similarly, one end of the capacitor C3 is connected to a cathode of the diode D4. One end of a series branch of the switching devices S7 and S8 is connected to an anode of the diode D4. The other end of the capacitor C2 is connected to the line 2 and, at the same time, connected to a middle point of the series branch of the switching devices S1 and S2. The other end of the capacitor C3 is connected to the other end of the series branch of the switching devices S1 and S2 and connected to a middle point of the series branch of the switching devices S7 and S8. The other end of the series branch of the switching devices S7 and S8 is connected to the negative side terminal of the DC power source B.

The pulse generating circuit according to the present embodiment is not limited to the construction shown in FIG. 12. That is, each of the diodes serially connected to the line 1 in the diagram is combined with the capacitor and the series branch of the switching devices connected before and after the diode, thereby constituting a transition voltage generating circuit of one stage. The transition voltage generating circuit of a plurality of stages are cascade-inserted between the DC power source B and the foregoing resonance circuit, thereby constituting the pulse generating circuit according to the embodiment.

That is, it is possible to consider that the embodiment shown in FIG. 12 is constructed by inserting the transition voltage generating circuit of two stages and second embodiment shown in FIG. 10 described above is constructed by inserting the transition voltage generating circuit of only one stage.

Subsequently, the operation of the pulse generating circuit according to the embodiment will be described with reference to the circuit diagram of FIG. 12 and an operation time chart shown in FIG. 13 in the circuit.

ON/OFF states of all of the switching devices S1 to S8 included in the circuit are controlled by the logic levels of switching signals SW1 to SW8 which are supplied from the drive control circuit 51 shown in FIG. 7. To simplify the disclosure in the following explanation, however, an explanation regarding each of the switching signals which are supplied from the drive control circuit 51 is omitted and only changes of the ON/OFF states of the switching devices S1 to S8 are time-sequentially disclosed.

In the following description, it is assumed that the switching devices S1 to S8 are merely shown by S1 to S8 and other devices such as capacitor C1 and inductor L1 are also similarly shown by only reference characters such as C1 and L1.

Figure 13:
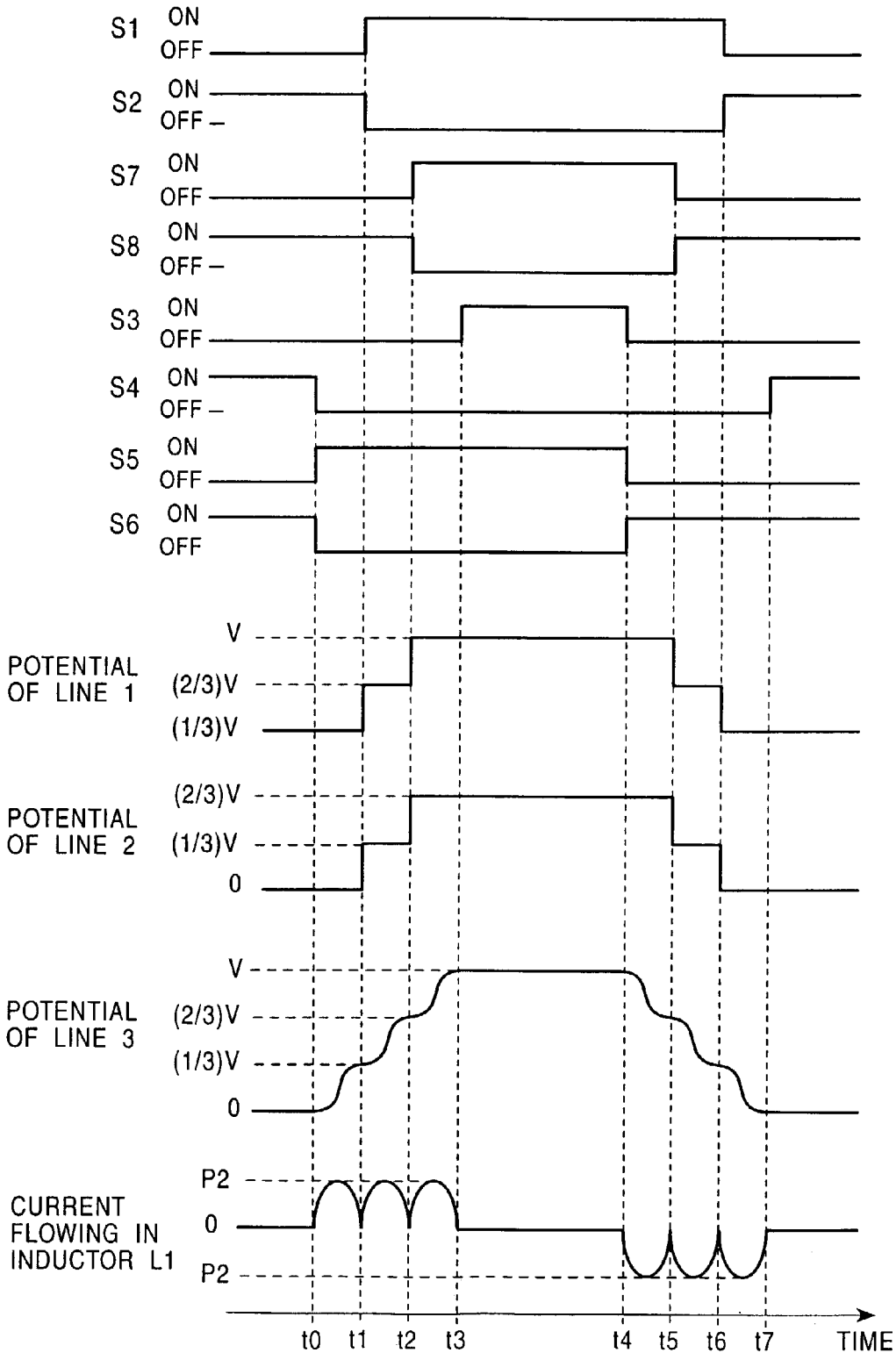
FIG. 13 is a diagram showing an operation time chart of the pulse generating circuit shown in FIG. 12.

First, at a point just before time point t0 shown in a time chart of FIG. 13, S1, S3, S5, and S7 are OFF and S2, S4, S6, and S8 are ON, respectively. The line 1, therefore, is connected to the positive side terminal of the DC power source B via the diodes D3 and D4. The electric potential of the line 1 is equal to (⅓)V as an electric potential of the DC power source B.

Similarly, since the lines 2 and 3 are connected to the earth potential Vs via S4, S2, and S8, their electric potentials are equal to the earth potential Vs of the PDP, that is, 0 [V].

Each of C2 and C3 connected between the lines 1 and 2 has, consequently, been charged to the electric potential of (⅓)V. In the embodiment, it is assumed that C1 included in the resonance circuit has been charged to an electric potential of (⅙)V by the means (not shown) at the time of turn-on of the power source of the apparatus.

When S4 and S6 are turned off and S5 is turned on at time point t0, a path of C1→S5→D1→L1 is formed in the resonance circuit and the charges charged in C1 flow into C0 via the line 3. At this time, since the current flowing in L1 of the resonance circuit is a resonance current of L1 of the resonance circuit and the capacitive component $C_0$ of the PDP 10, as shown in FIG. 13, it increases gradually from ON start time point t0 of S5 and, when the resonance current reaches a positive peak current value P2, it decreases gradually after that.

As shown in FIG. 13, the electric potential of the line 3 rises gradually from 0 [V] at time point t0 and becomes an electric potential of almost (⅓)V at time point t1 when the resonance current flowing in L1 decreases and becomes 0. Since the electric potential mentioned above is caused by the resonance phenomenon of the resonance circuit including L1, it is equal to a value higher than the initial charge potential (⅙)V in C1.

At time point t1 when the electric potential of the line 3 is almost equal to (⅓)V, S1 is turned on, S2 is turned off, and the terminal of C2 on the line 2 side is connected to the terminal of C3 on the line 1 side via S1. The electric potential of the line 1 rises to (⅔)V because the charge potential (⅓)V of C3 is added to the charge potential (⅓)V of C2.

Also with respect to C1, the bias electric potential (⅓)V due to C3 is added to the conventional charge potential (⅙)V of C1, so that the electric potential of C1 in the resonance circuit rises to (½)V. Due to the increase in electric potential mentioned above, the discharge from C1 to C1 is restarted. The resonance current flows again via S5, D1, and L1, that is, the resonance transition of the second time (time point t1 to t2) occurs subsequently to the resonance transition of the first time (time point t0 to t1) and the electric potential of the line 3 continues to rise. The resonance current in this case shows a change as shown in FIG. 13, that is, it increases gradually and, when it reaches the peak value P2, it decreases gradually after that in a manner similar to the foregoing case of time point t0 to t1.

At time point t2 when the electric potential of the line 3 is almost equal to (⅔)V, S7 is turned on, S8 is turned off, and the terminal of C3 on the line 2 side is connected to the positive terminal side of the DC power source B via S7. The electric potential of the line 1, thus, rises to the maximum electric potential V because the bias potential (⅓)V due to the DC power source B is further added to the charge potential (⅓)V of C2 and the charge potential (⅓)V of C3.

Also with respect to C1, the charge potential (⅓)V of C3 and the bias electric potential (⅓)V due to the DC power source B are similarly added to the initial charge potential (⅙)V, so that the electric potential of C1 in the resonance circuit rises to (⅚)V. The discharge from C1 to C0 is, thus, restarted and the resonance current flows again via S5, D1, and L1, that is, the resonance transition of the third time (time point t2 to t3) occurs subsequently to the resonance transition of the second time (time point t1 to t2) and the electric potential of the line 3 continues to rise. The resonance current in this case also shows a change as shown in FIG. 13, that is, it increases gradually and, when it reaches the peak value P2, it decreases gradually after that in a manner similar to the foregoing cases of time point t0 to t1 and time point t1 to t2.

At time point t3 when the electric potential of the line 3 is almost equal to V, S3 is turned on and the line 3 is clamped to the maximum electric potential V as an electric potential of the line 1.

After that, S3 and S5 are turned off and S6 is turned on at time point t4. The clamping of the maximum potential V in the line 3 is, therefore, released and, at the same time, the conventional resonance current path via S5→D1→L1 is also disconnected.

By the above switching operation, a resonance current path of L1→D2→S6→C1 is newly formed and the charges charged in the capacitive component $C_0$ of the PDP 10 are discharged toward C1. That is, the resonance current starts to flow again via the line 3 and the charges accumulated in C0 are now collected into C1. Since the resonance current at this time flows in the direction from C0 to C1, when the direction of the current between time points t0 and t3 mentioned above is assumed to be positive, the direction of the resonance current at this time is the opposite direction as shown in FIG. 13, that is, the resonance current at this time can be expressed as a resonance current in the negative direction. When the resonance current starts to flow, the charges accumulated in C0 decrease gradually. In association with it, the electric potential of the line 3 also decreases gradually.

At time point t5 when the electric potential of the line 3 decreases to almost (⅔)V, S7 is now turned off and S8 is turned on. The electric potential of the line 2 is, thus, set to only (⅓)V as a charge potential of C3 because the bias potential (⅓)V due to the DC power source B is removed. The electric potential of C1 in the resonance circuit also decreases to (½)V obtained by adding the initial charge potential (⅙)V in C1 to the electric potential (⅓)V of the line 2.

The discharge from C0 to C1 is, thus, restarted. The resonance transition of the fifth time (time point t5 to t6) occurs subsequently to the resonance transition of the fourth time (time point t4 to t5) and the electric potential of the line 3 continues to decrease. The resonance current flowing in L1 in this instance shows a change as shown in FIG. 13, that is, it increases gradually in the negative direction and, when it reaches the peak value P2, it decreases gradually after that in a manner similar to the foregoing case of time point t4 to t5.

At time point t6 when the electric potential of the line 3 decreases to almost (⅓)V after that, S1 is now turned off and S2 is turned on. The electric potential of the line 2 is, therefore, equal to the earth potential Vs, that is, 0 [V] and the electric potential of C1 in the resonance circuit also decreases to (⅙)V as an initial charge potential.

The discharge from C0 to C1 is, thus, restarted. The resonance transition of the sixth time (time point t6 to t7) occurs subsequently to the resonance transition of the fifth time (time point t5 to t6) and the electric potential of the line 3 further decreases. Naturally, the resonance current in this instance also shows a change as shown in FIG. 13 in a manner similar to the foregoing cases of time point t4 to t5 and time point t5 to t6.

After that, at time point t7 when the electric potential of the line 3 is almost equal to 0 [V], S4 is turned on and the electric potential of the line 3 is clamped to the earth potential Vs of the PDP, that is, 0 [V]. At time point t7, the diodes D3 and D4 are made conductive, the charges of C2 and C3 are supplemented by the DC power source B, and the electric potential of the line 1 is equal to (⅓)V.

By the operation described above, a pulse waveform shown in FIG. 13 is generated on the line 3 in FIG. 12 and the pulse is supplied as each pulse such as sustain pulse $IP_x$ or pixel data pulse DP to the PDP 10 via the line 3 also serving as an output terminal.

As will be also obviously understood from the above description, a voltage range where the switching devices S1 to S8 included in the circuit of the embodiment execute the switching operation is limited to [0⇆(⅓)V], [(⅓)V⇆(⅔)V], or [(⅔)V⇆V]. That is, it is sufficient that all of the withstanding voltages of the switching devices in the circuit are set to (⅓)V and it is sufficient that they can be set to ⅓ of the withstanding voltage in the conventional circuit. Miniaturization and low costs of the switching devices which are used in the pulse generating circuit are, consequently, accomplished.

Naturally, it is also sufficient that the maximum voltage of the DC power source B which should be provided as a pulse generating circuit can be set to (⅓)V as a value which is equal to ⅓ of the conventional one.

Further, if electric power consumption in the conventional driving circuit shown in FIG. 3 is assumed to be W0, it can be expressed by $$W0=C_0\cdot V^2\cdot f \tag{5}$$

where, $C_0$: capacitive component of the PDP 10

V: voltage of the DC power source f: driving frequency

In the driving circuit of the embodiment shown in FIG. 12, since the power voltage is equal to ⅓ of that of the conventional circuit and the driving frequency is equal to thrice as large as that of the conventional circuit, if electric power consumption in the driving circuit is assumed to be W3, it can be expressed by $$W3=C_0\cdot(V/3)^2\cdot(3f)=(1/3)\cdot C_0V^2f \tag{6}$$

It will be understood that W3 is almost equal to ⅓ of the electric power consumption W0 in the conventional circuit.

The construction of the embodiment is not limited to the circuit shown in FIG. 12 as mentioned above. That is, by increasing the number of cascade stages of what are called transition voltage generating circuits which are inserted between the DC power source and the resonance circuit, switching devices of a further low withstanding voltage can be used. The electric power consumption in the circuit and the voltage value of the DC power source which should be provided for the circuit can be further reduced.

In the display apparatus having the capacitive load, the first to third embodiments can be applied to any of the sustain pulse generating circuit and the pixel data pulse generating circuit.

Although the pulse generating circuit using the drive pulse of the positive polarity has been described in the first to third embodiments, the invention is not limited to it but can be also applied to a pulse generating circuit using a drive pulse of a negative polarity.

Although the inductors L1 and L2 in the resonance circuit have been used in common in the charging path and the discharging path for the capacitive component $C_0$ of the PDP 10 in the first to third embodiments, the invention is not limited to it but the inductor can be also independently provided for each of the charging path and the discharging path.

As described in detail above, according to the driving apparatus of the display panel of the invention, the low electric power consumption of the apparatus can be realized. The voltage value of the DC power source built in the apparatus can be reduced, so that switching devices of a low withstanding voltage can be used.

Figure 14:
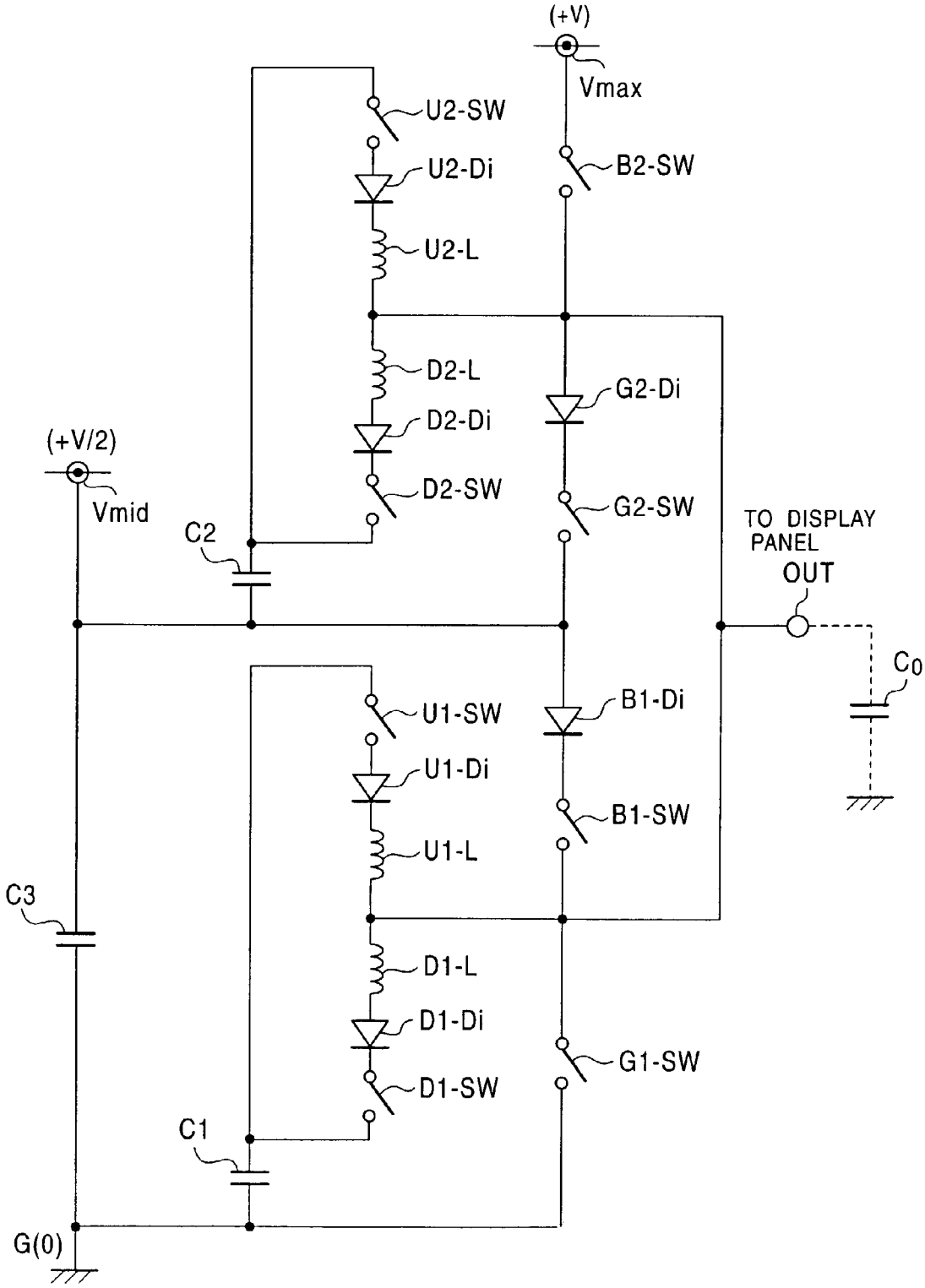
FIG. 14 is a circuit diagram showing the fourth embodiment of a display panel driving circuit based on the invention.
Figure 19:
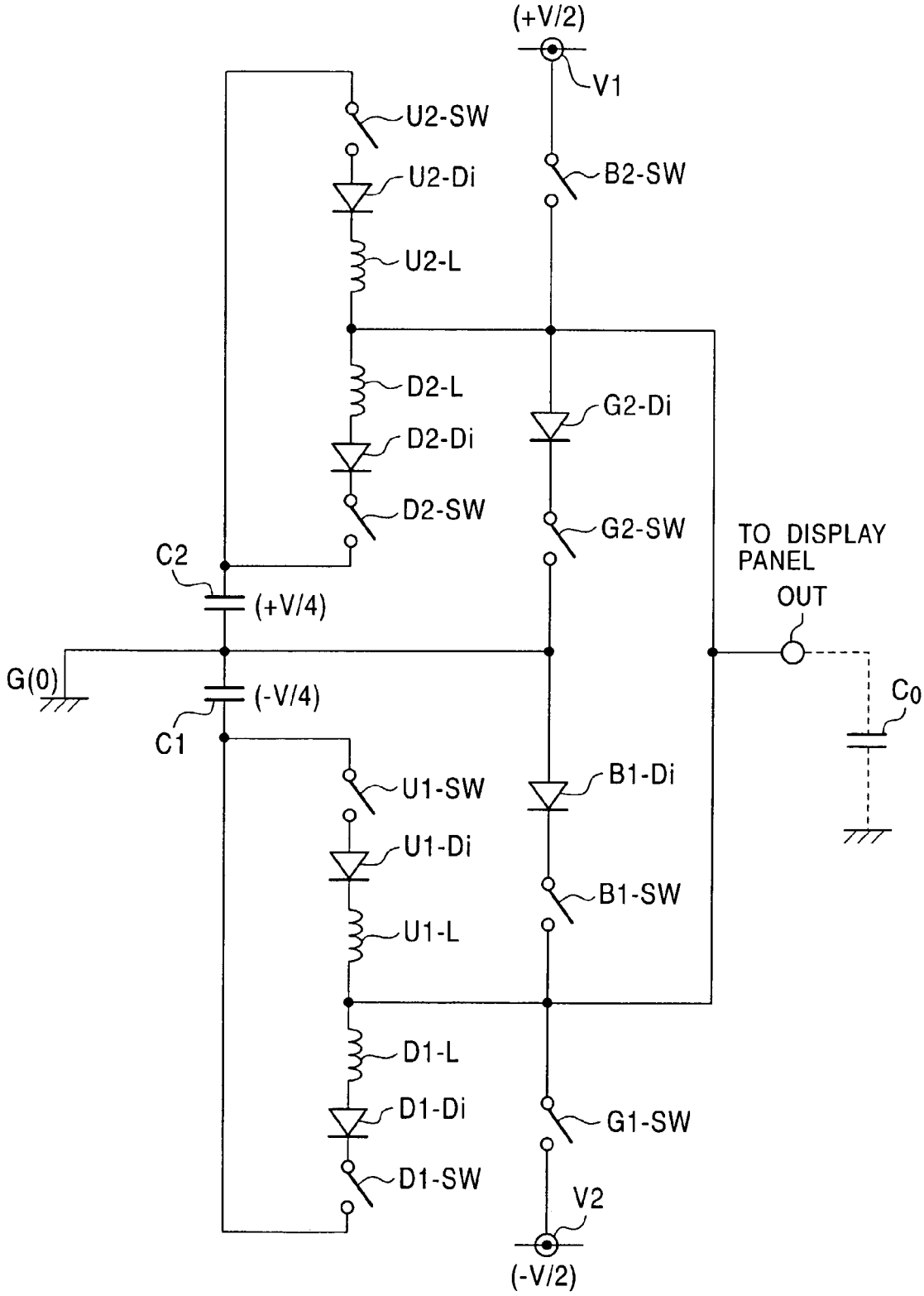
FIG. 19 is a circuit diagram showing the fifth embodiment of a display panel driving circuit based on the invention.

A display panel driving circuit according to the invention will be described. As shown in FIG. 14 or 19, which will be explained hereinlater, it is assumed that the display panel driving circuit for driving the display panel according to the invention is provided in each of the row electrode driving circuits 31 and 41 and the column electrode driving circuit 21 shown in FIG. 7.

FIG. 14 shows the fourth embodiment of a display panel driving circuit according to the invention and a construction of the circuit will be described hereinbelow.

In FIG. 14, a negative side terminal (0 [V]) of the DC power source (not shown) for generating the DC voltage +V [V] is connected to an earth potential G (0 [V]) as an earth potential of the PDP 10. A positive side terminal (+V [V]) of the DC power source (not shown) is connected to a first power terminal Vmax of the present circuit.

One end of a switch B2-SW is connected to the power terminal Vmax. The other end of the switch B2-SW is connected to an anode of a diode G2-Di, an output terminal OUT, a series branch U2, and a series branch D2.

The output terminal OUT is an output terminal of the pulse signal which reaches each row electrode or column electrode of the PDP 10. The capacitive component $C_0$ of the discharge cell $C_{(i,j)}$ in the PDP 10 is connected to the output terminal OUT. An output driver circuit can be also inserted as necessary onto a path starting from the output terminal OUT and reaching the capacitive component $C_0$.

The series branch U2 denotes a serial circuit comprising an inductor U2-L, a diode U2-Di, and a switch U2-SW. Similarly, the series branch D2 denotes a serial circuit comprising an inductor D2-L, a diode D2-Di, and a switch D2-SW.

The other end of each of the series branches U2 and D2 is connected to one end of the capacitor C2. A portion comprising the series branches U2 and D2 and the capacitor C2 constitutes the second resonance circuit in the embodiment.

A cathode of the diode G2-Di is connected to one end of the switch G2-SW. The other end of the switch G2-SW is connected to an anode of a diode B1-Di, the other end of the capacitor C2, one end of the capacitor C3, and a second power terminal Vmid of the present circuit. In the embodiment, it is assumed that a voltage +V/2 [V] as an electric potential of ½ of the first power terminal Vmax is supplied to Vmid.

A cathode of the diode B1-Di is connected to one end of a switch B1-SW. The other end of the switch B1-SW is connected to one end of a switch G1-SW, a series branch U1, a series branch D1, and the output terminal OUT. The series branch U1 denotes a serial circuit comprising an inductor U1-L, a diode U1-Di, and a switch U1-SW. Similarly, the series branch D1 denotes a serial circuit comprising an inductor D1-L, a diode D1-Di, and a switch D1-SW.

The other end of each of the series branches U1 and D1 is connected to one end of the capacitor C1. The series branches U1 and D1 and the capacitor C1 constitutes the first resonance circuit in the embodiment in a manner similar to the second resonance circuit.

The other end of the switch G1-SW is connected to the other end of the capacitor C1, the other end of the capacitor C3, and the earth potential G (0 [V]).

Subsequently, the operation of the display panel driving circuit according to the first embodiment of the invention will be described with reference to the circuit diagram of FIG. 14 and a time chart shown in FIG. 15.

Each of the switching devices included in the present circuit can be constituted, for example, by using a portion between a drain terminal and a source terminal of an FET or other switching devices can be used. In case of using the FET, it is assumed that ON/OFF states of the switching device are controlled by a control signal which is applied to a gate terminal of the FET.

It is assumed that ON/OFF states of all of the switches shown in FIG. 14 are controlled by the logic levels of the control signals which are supplied from the drive control circuit 51 shown in FIG. 13. For simplicity of explanation, however, in the following description, a disclosure regarding each of the control signals which are supplied from the drive control circuit 51 is omitted and only changes of the ON/OFF states of the switches are time-sequentially disclosed.

In the following description, all of names of the switches are disclosed by only reference characters such as U1-SW. Similarly, other devices such as capacitor and inductor are also shown by only reference characters such as C1 and U1-L.

Figure 15:
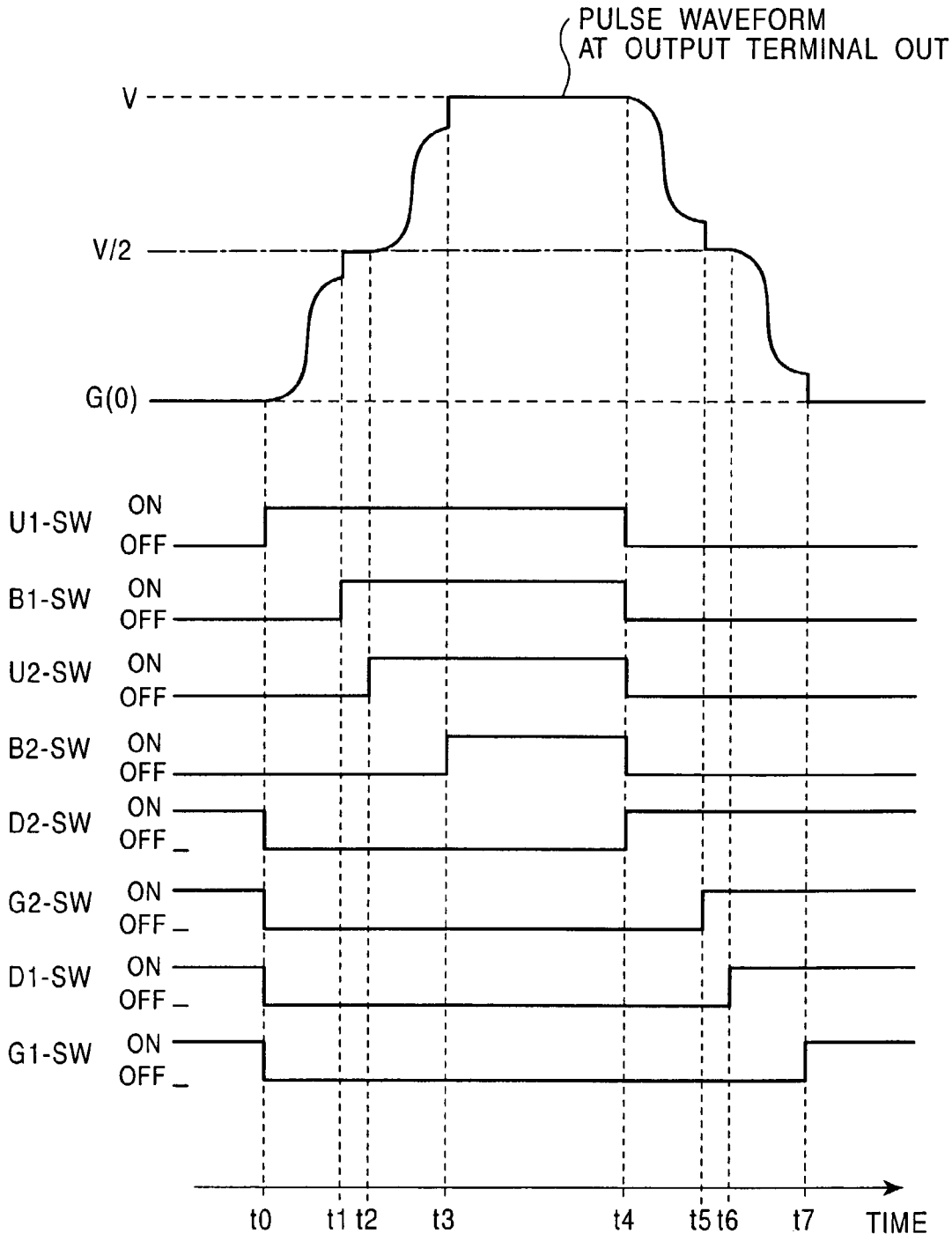
FIG. 15 is a time chart showing the operation in the display panel driving circuit of FIG. 14.
Figure 16:
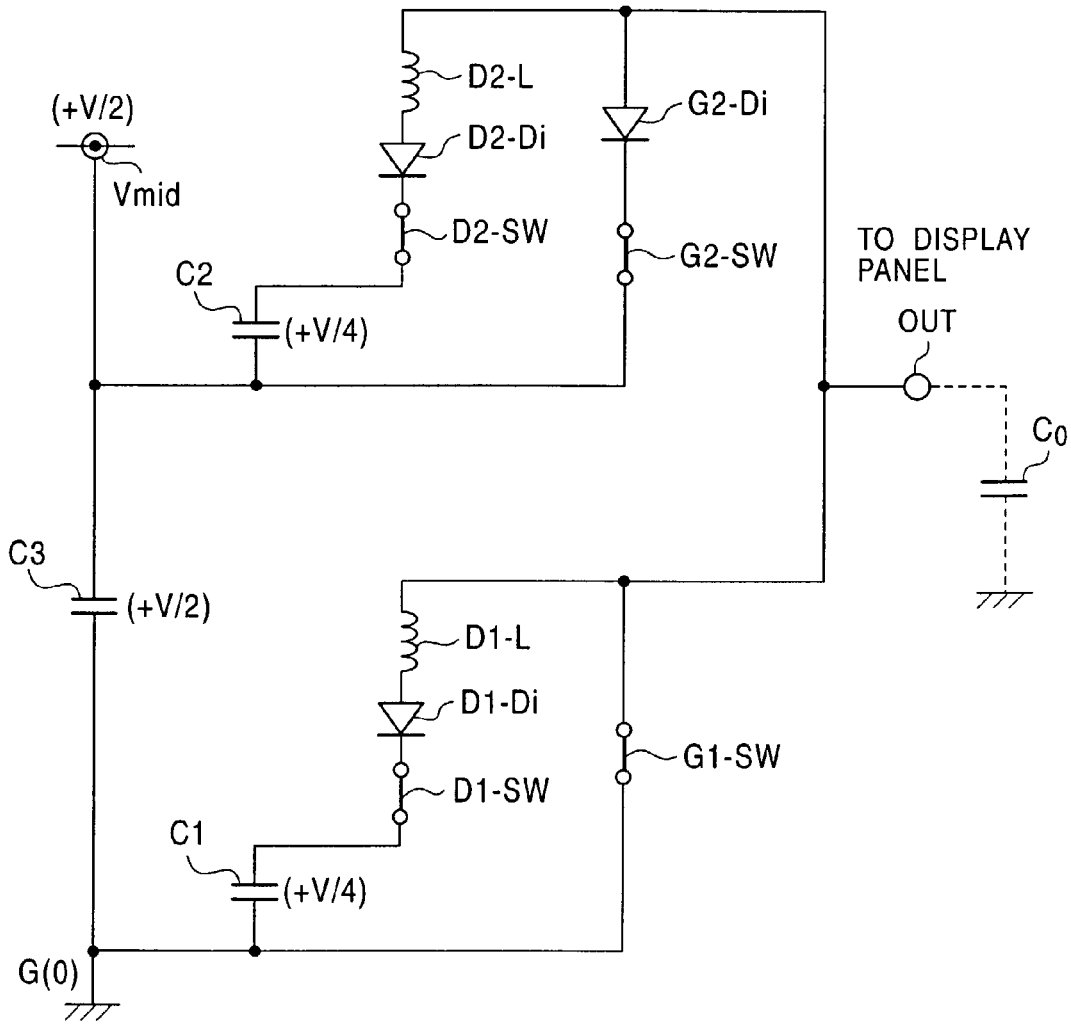
FIG. 16 is a connection diagram showing a connecting state just before time point t0 of the display panel driving circuit of FIG. 14.

First, at a point just before time point to shown in the time chart of FIG. 15, the switches U1-SW, B1-SW, U2-SW, and B2-SW are OFF and the switches D2-SW, G2-SW, D1-SW, and G1-SW are ON. A connecting state of the circuit in this case is shown in a connection diagram of FIG. 16. As will be also obvious from the diagram, the output terminal OUT is connected to the earth potential via G1-SW and its electric potential is equal to the earth potential of the PDP, that is, 0 [V].

In the embodiment, it is assumed that C1 and C2 have been charged to an electric potential of +V/4 [V] by the means (not shown) upon turn-on of the power source of the present circuit. Naturally, C3 connected between Vmid and the ground has also been charged to +V/2 [V] as an electric potential of Vmid. A positive electric potential, therefore, has been applied to all cathodes of diodes shown in FIG. 16. Since the output terminal OUT is connected to the ground as mentioned above, all anodes of the diodes are equal to 0 [V]. All of the diodes shown in FIG. 16, therefore, are nonconductive and there is no fear that the electric potential on the cathode side of each diode exerts influence on the output terminal OUT.

Subsequently, at time point t0, the switches of D2-SW, G2-SW, D1-SW, and G1-SW which have been in the ON state so far are turned off and U1-SW is turned on. The output terminal OUT, therefore, is connected to C1 via the series branch U1 of the first resonance circuit comprising U1-L, U1-Di, and U1-SW. As mentioned above, C1 has been charged to the electric potential of +V/4 [V] and the electric potential of the output terminal OUT is equal to 0 [V]. The charges charged in C1, therefore, are moved from the output terminal OUT to the capacitive component $C_0$ of the discharge cell $C_{(i,j)}$ in the PDP 10 via the series branch U1. That is, the current which charges C0 starts to flow via the series branch U1.

In association with that C0 is charged, the electric potential of C0, that is, the electric potential of the output terminal OUT rises gradually from the earth potential 0 [V]. The increase in electric potential mentioned above is caused due to the resonance phenomenon by U1-L and C0. An increase rate of the potential increase for an increasing period of time of the resonance current is, therefore, large and there is a tendency such that the increase rate of the potential increase for a decreasing period of time of the resonance current is saturated. Further, the increase in electric potential due to the resonance phenomenon is caused over the initial charge potential +V/4 [V] in C1.

Although the electric potential of the output terminal OUT continues to rise again, it cannot rise to +V/2 [V] due to a loss by a resistance component and, at a time point when the resonance current is equal to 0, the diode U1-Di is turned off and it is clamped to an electric potential lower than +V/2 [V]. At time point t1 after the clamping, B1-SW is turned on and the output terminal OUT is connected to Vmid via B1-SW and B1-Di. The electric potential of the output terminal OUT, consequently, rises rapidly to +V/2 [V] as an electric potential of Vmid and is clamped to the electric potential of +V/2 [V].

At subsequent time point t2, U2-SW is now turned on and the output terminal OUT is connected to C2 via the series branch U2 of the second resonance circuit comprising U2-L, U2-Di, and U2-SW. As mentioned above, the initial charge potential of C2 is equal to +V/4 [V]. In the circuit of FIG. 14, however, +V/2 [V] as a charge potential of C3 is added as a bias potential to C2. That is, since the bias potential is added, the electric potential of C2 when it is seen from the output terminal OUT is equal to $$(+V/4\ [V])+(+V/2\ [V])=+3V/4\ [V]$$

At time point t2 shown in the time chart of FIG. 15, therefore, the electric potential of C2 is higher than the electric potential (+V/2 [V]) of the output terminal OUT by +V/4 [V]. Due to the potential difference, the charge current starts to flow again into C0 from C2 via the series branch U2 and the output terminal OUT.

In association with that C0 is again charged, the electric potential of the output terminal OUT starts to rise gradually from +V/2 [V]. The increase in electric potential is caused due to the resonance phenomenon by U2-L and C0. If circuit constants of the inductors and the like in the first and second resonance circuits are set to be identical, therefore, the potential increase of the output terminal OUT shows a tendency similar to that in the case of the resonance phenomenon by the first resonance circuit shown at time point t0 to t1 mentioned above.

In the time chart of FIG. 15, B1-SW which plays a role of clamping the electric potential of the output terminal OUT to +V/2 [V] is not turned off at time point t2. This is because the electric potential on the cathode side of B1-Di is higher than +V/2 [V] as an electric potential on the anode side by the turn-on of U2-SW, B1-SW is made nonconductive, and the clamping of the output terminal OUT is automatically released.

Although the electric potential of the output terminal OUT continues to rise again, it cannot rise to +V [V] due to the loss by the resistance component and, at a time point when the resonance current is equal to 0, the diode U2-Di is turned off and it is clamped to an electric potential lower than +V [V]. B2-SW is turned on at time point t3 after the clamping. The output terminal OUT is, thus, directly connected to the power terminal Vmax via B2-SW. The electric potential of the output terminal OUT, therefore, rises rapidly to +V [V] as an electric potential of Vmax and is clamped to the maximum potential +V [V] of the circuit.

Figure 17:
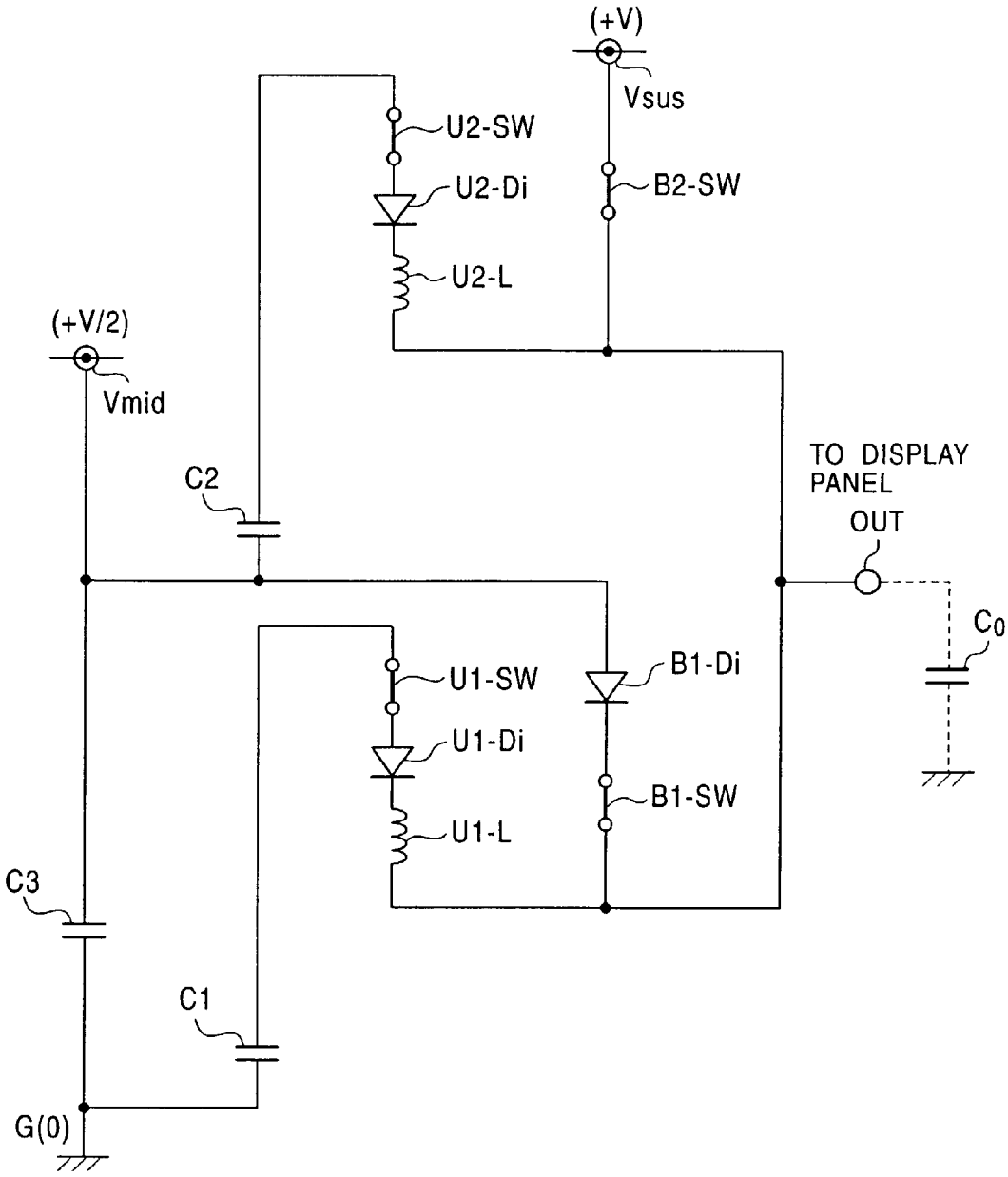
FIG. 17 is a connection diagram showing a connecting state just after time point t3 of the display panel driving circuit of FIG. 14.

FIG. 17 shows a connecting state of the display panel driving circuit in a state where the output terminal OUT has been clamped to the maximum potential +V [V] after the elapse of time point t3. In the diagram, although all of the switches of U1-SW, B1-SW, U2-SW, and B2-SW are ON, the positive maximum potential +V [V] is applied to all cathodes of the diodes shown in the diagram. All of the diodes, therefore, are made nonconductive and there is no fear that the electric potential on the anode side of each diode exerts influence on the output terminal OUT.

Subsequently, the operation at the time when the pulse waveform from the output terminal OUT trails will be described.

First, at time point t4 of the time chart shown in FIG. 15, the switches of U1-SW, B1-SW, U2-SW, and B2-SW which have been in the ON state so far are turned off and D2-SW is turned on. The output terminal OUT is, thus, connected via the series branch D2 of the second resonance circuit comprising D2-L, D2-Di, and D2-SW. That is, C0 connected to the output terminal OUT is connected to C2 via the series branch D2.

As mentioned above, the electric potential of C2 when it is seen from the output terminal OUT, that is, from C0 is equal to +3V/4 [V] including the bias potential by C3. For a period of time between time points t3 and t4, C0 has been charged to the maximum potential +V [V]. In this case, therefore, C2 collects the charges accumulated in C0. That is, the resonance current due to D2-L and C2 of the second resonance circuit starts to flow in a form of discharging from C0 toward C2. Since the clamping of the maximum potential +V [V] has been released by the turn-off of B2-SW, the electric potential of the output terminal OUT decreases gradually as shown in FIG. 15 in association with the discharge of C0.

Although the direction of the resonance current at this time is opposite to that upon rising of the electric potential, if circuit constants of the D2 branch and U2 branch in the resonance circuit are identical, a state of the potential change shows a tendency similar to that upon rising. That is, a decrease rate of the electric potential at the time of an increase in resonance current is large and a decrease rate of the electric potential at the time of a decrease in resonance current is saturated. The electric potential of C0, that is, the electric potential of the output terminal OUT decreases over V/4 [V] as a potential difference between C0 and C2 at the start of the discharge of C0.

At time point t5 just before the electric potential of the output terminal OUT decreases to +V/2 [V], G2-SW is turned on and the output terminal OUT is now connected to Vmid via G2-SW and G2-Di. The electric potential of the output terminal OUT, thus, decreases rapidly to +V/2 as an electric potential of Vmid and is clamped to +V/2 [V].

At subsequent time point t6, D1-SW is now turned on and the output terminal OUT is connected to C1 via the series branch D1 of the first resonance circuit comprising D1-L, D1-Di, and D1-SW. As mentioned above, the charge potential of C1 is equal to +V/4 [V] and the electric potential of the output terminal OUT at time point t6, that is, the electric potential of C0 is equal to +V/2 [V]. The charges, therefore, are now collected from C0 to C1 and the resonance current due to D1-L and C1 of the first resonance circuit starts to flow. The electric potential of the output terminal OUT, thus, also starts to again decrease from +V/2 [V].

At time point t7 just before the electric potential of the output terminal OUT further decreases and is equal to 0 [V], G1-SW is turned on and the output terminal OUT is directly connected to the earth potential 0 [V]. The electric potential of the output terminal OUT is, thus, clamped to the earth potential 0 [V].

In the display panel driving circuit of FIG. 14, the operation described above is repetitively executed based on the control signals for the respective switches which are supplied from the drive control circuit 51 shown in FIG. 13. A pulse waveform shown in FIG. 15, thus, periodically appears at the output terminal OUT of the display panel driving circuit.

Figure 18:
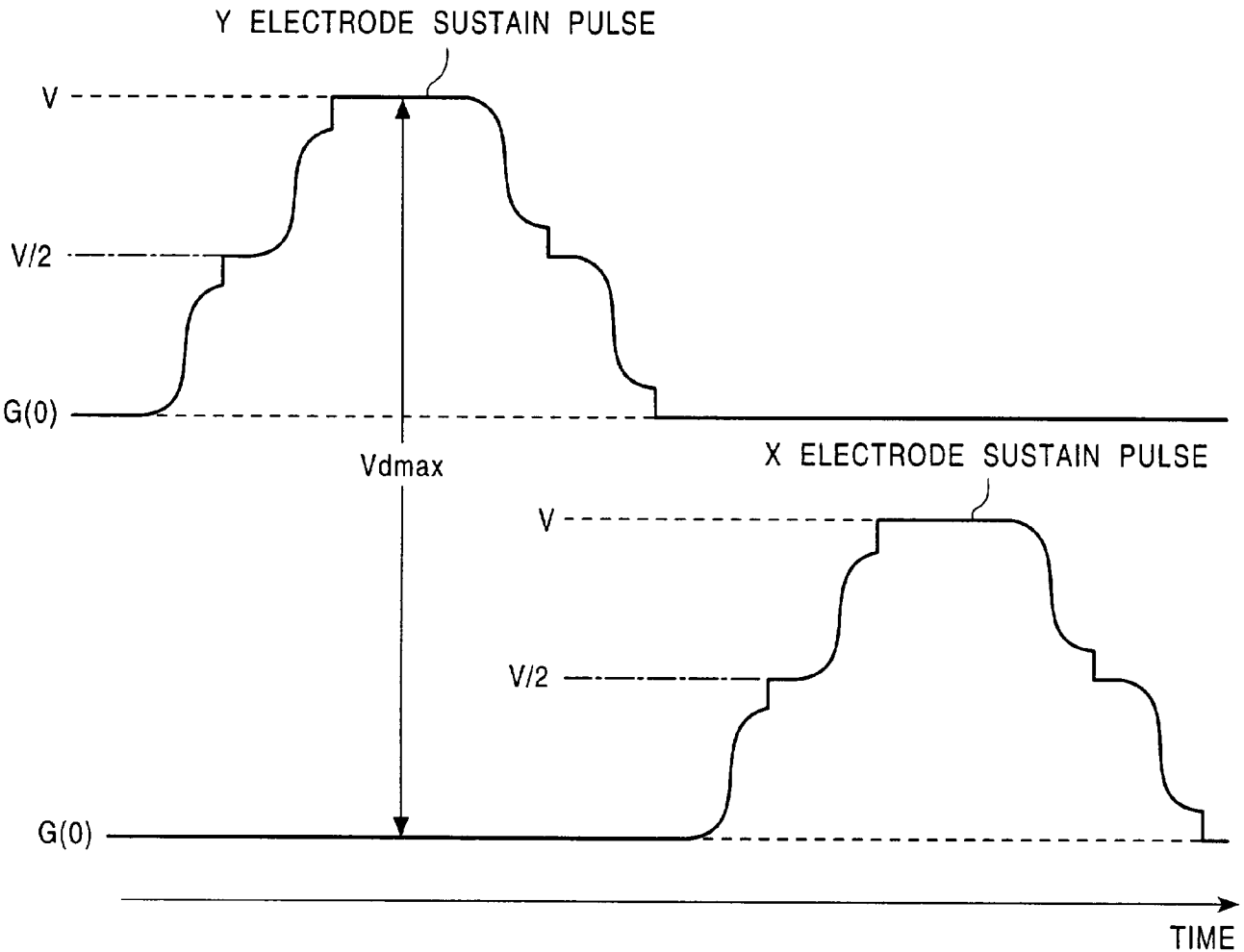
FIG. 18 is a time chart showing examples of drive pulses which are generated from the display panel driving circuit of FIG. 14.

States of pulse waveforms in the Y electrode and the X electrode in the case where the display panel driving circuit according to the embodiment is used as, for example, a generating circuit (sustain driver) of the sustain pulses $IP_y$ and $IP_x$ in the row electrode driving circuits 31 and 41 are shown in a time chart of FIG. 18.

Although the power voltage has been set to +V [V] and +V/2 [V] and the generating circuit of what is called a positive polarity pulse has been used in the circuit shown in FIG. 14, the embodiment is not limited to it. For example, it is also possible to construct a generating circuit of a negative polarity pulse by using a negative power source and setting the polarity of the diode to the opposite polarity.

In the embodiment, by changing the electric potential of the second power terminal Vmid, a shape of the pulse waveform can be adjusted. The shape of the pulse waveform, therefore, can be further optimized in accordance with a situation of a load to be driven in order to effectively reduce the electric power consumption. In the embodiment, the electric potential of the capacitor C3 in FIG. 14 is automatically settled to +V/2 [V] by the operation of the circuit. In case of fixing the electric potential of Vmid to +V/2 [V] and using the display panel driving circuit, therefore, the DC power source for applying the voltage to Vmid can be omitted.

The fifth embodiment of the display panel driving circuit according to the invention will now be explained.

The construction of the fifth embodiment is shown in a circuit diagram of FIG. 19. In the diagram, the earth terminal (0 [V]) of the DC power source (not shown) for generating the DC voltages +V/2 [V] and −V/2 [V] is connected to the earth potential G (0 [V]) as an earth potential of the PDP 10. The positive side terminal (+V/2 [V]) of the DC power source (not shown) is connected to a first power terminal V1 of the present circuit and the negative side terminal (−V/2 [V]) is connected to a second power terminal V2 of the present circuit, respectively.

One end of the switch B2-SW is connected to the power terminal V1. The other end of the switch B2-SW is connected to the anode of the diode G2-Di, the series branch U2, the series branch D2, and the output terminal OUT.

The output terminal OUT is an output terminal of the pulse signal which reaches each row electrode or column electrode of the PDP 10. The capacitive component $C_0$ of the discharge cell $C_{(i,j)}$ in the PDP 10 is connected to the output terminal OUT. An output driver circuit can be also inserted as necessary onto a path starting from the output terminal OUT and reaching the capacitive component $C_0$.

The series branch U2 denotes a serial circuit comprising the inductor U2-L, the diode U2-Di, and the switch U2-SW. Similarly, the series branch D2 denotes a serial circuit comprising the inductor D2-L, the diode D2-Di, and the switch D2-SW.

The other end of each of the series branches U2 and D2 is connected to one end of the capacitor C2. A portion comprising the series branches U2 and D2 and the capacitor C2 constitutes the second resonance circuit in the embodiment.

The cathode of the diode G2-Di is connected to one end of the switch G2-SW. The other end of the switch G2-SW is connected to the anode of the diode B1-Di, the other end of the capacitor C2, one end of the capacitor C1, which will be explained hereinlater, and the earth potential.

The cathode of the diode B1-Di is connected to one end of the switch B1-SW. The other end of the switch B1-SW is connected to one end of the switch G1-SW, the output terminal OUT, the series branch U1, and the series branch D1. The series branch U1 denotes a serial circuit comprising the inductor U1-L, the diode U1-Di, and the switch U1-SW. Similarly, the series branch D1 denotes a serial circuit comprising the inductor D1-L, the diode D1-Di, and the switch D1-SW.

The other end of each of the series branches U1 and D1 is connected to one end of the capacitor C1. The series branches U1 and D1 and the capacitor C1 constitutes the first resonance circuit in the embodiment in a manner similar to the second resonance circuit.

The other end of the switch G1-SW is connected to V2 (−V/2 [V]) as a second power terminal of the present circuit.

Subsequently, the operation of the display panel driving circuit according to the second embodiment of the invention will be described with reference to the circuit diagram of FIG. 19 and a time chart shown in FIG. 20.

Each of the switching devices included in the present circuit can be constituted, for example, by an FET utilising the switch function between the drain terminal and the source terminal, or using other switching devices. In the case of using an FET, it is assumed that ON/OFF states of the switching device are controlled by a control signal which is applied to the gate terminal of the FET.

It is assumed that ON/OFF states of all of the switches shown in FIG. 14 are controlled by the logic levels of the control signals which are supplied from the drive control circuit 51 shown in FIG. 13. For the purpose of the simplicity of explanation, however, a disclosure regarding each of the control signals which are supplied from the drive control circuit 51 is omitted and only changes of the ON/OFF states of the switches are described according to the time-sequence in the following description.

In the following description, all of names of the switches are disclosed by only reference characters such as U1-SW. Similarly, other devices such as capacitor and inductor are also shown by only reference characters such as C1 and U1-L.

Figure 20:
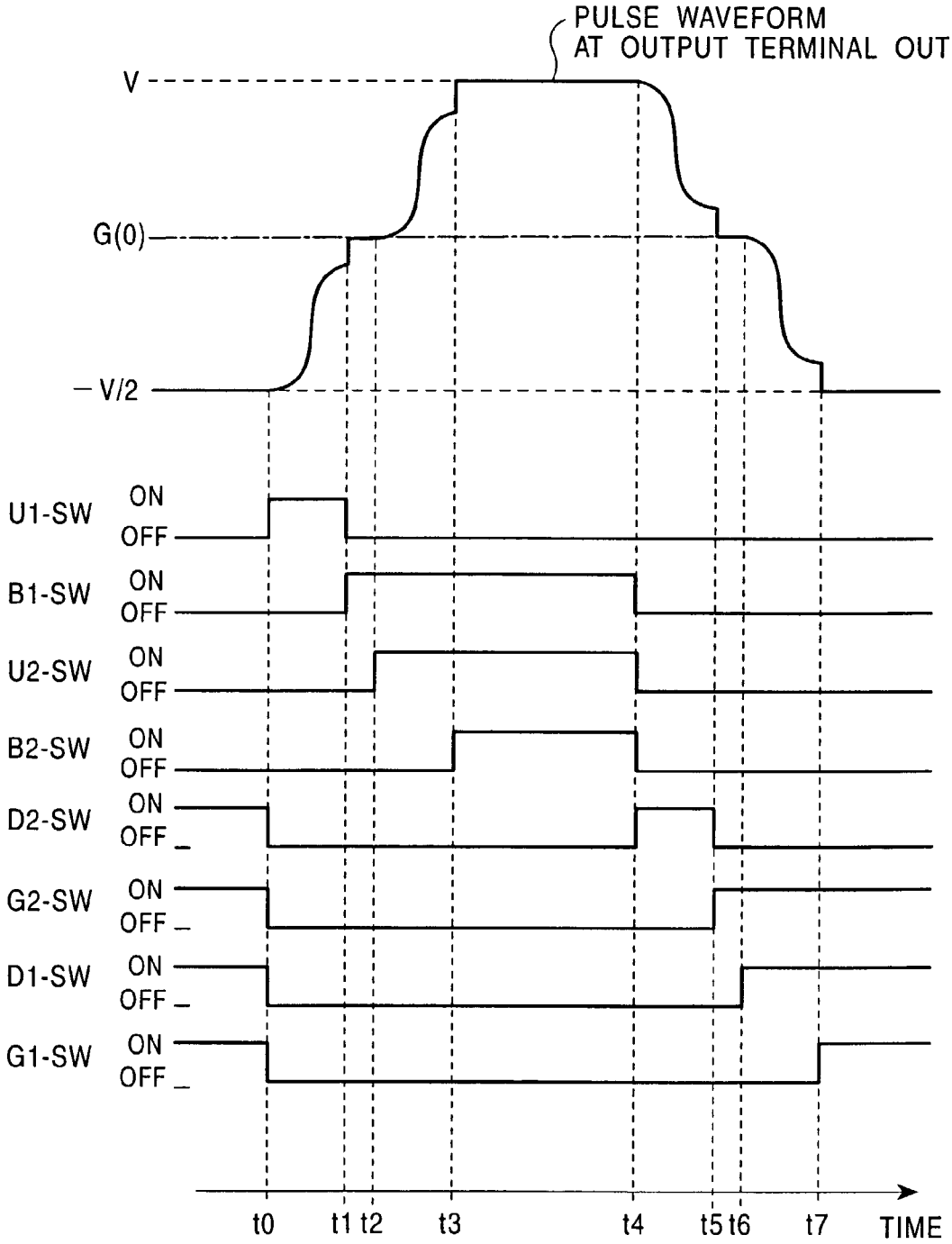
FIG. 20 is a time chart showing the operation of the display panel driving circuit of FIG. 19.

First, at a point just before time point to shown in the time chart of FIG. 20, the switches U1-SW, B1-SW, U2-SW, and B2-SW are OFF and the switches D2-SW, G2-SW, D1-SW, and G1-SW are ON. The output terminal OUT is, therefore, connected to the power terminal V2 via G1-SW and its electric potential is equal to −V/2 [V]. The capacitive component $C_0$ of the discharge cell $C_{(i,j)}$ of the PDP 10 connected to the output terminal OUT has, therefore, been charged to the electric potential of −V/2 [V] until time point to.

In the embodiment, it is assumed that C1 and C2 have been charged to the electric potentials of −V/4 [V] and +V/4 [V] by the means (not shown) at the time of turn-on of the power source of the present circuit, respectively.

Subsequently, at time point t0, the switches of D2-SW, G2-SW, D1-SW, and G1-SW which have been in the ON state so far are turned off and U1-SW is turned on. The output terminal OUT, therefore, is connected to C1 via the series branch U1 of the first resonance circuit comprising U1-L, U1-Di, and U1-SW.

As mentioned above, C1 has been charged to the electric potential of −V/4 [V] and the electric potential of the output terminal OUT is equal to −V/2 [V]. The charge current, therefore, starts to flow from C1 to C0 via the series branch U1 and the output terminal OUT due to the potential difference.

In association with it, the electric potential of C0, that is, the electric potential of the output terminal OUT rises gradually from −V/2 [V]. The increase in electric potential mentioned above is caused due to the resonance phenomenon by U1-L and C0. An increase rate of the potential increase for an increasing period of time of the resonance current is large and there is a tendency such that the increase rate of the potential increase for a decreasing period of time of the resonance current is saturated. Further, the increase in electric potential due to the resonance phenomenon is caused over the initial charge potential −V/4 [V] in C1.

Although the electric potential of the output terminal OUT continues to rise again, it cannot rise to 0 [V] due to the loss by the resistance component and, at a time point when the resonance current is equal to 0, the diode U1-Di is turned off and it is clamped to an electric potential lower than 0 [V]. At time point t1 after the clamping, B1-SW is turned on and U1-SW is turned off. The output terminal OUT is, thus, connected to the earth terminal via B1-SW and B1-Di. The electric potential of the output terminal OUT is, consequently, clamped to 0 [V].

At subsequent time point t2, U2-SW is now turned on and the output terminal OUT is connected to C2 via the series branch U2 of the second resonance circuit comprising U2-L, U2-Di, and U2-SW. As mentioned above, C2 has been charged to +V/4 [V] and its electric potential is higher than the electric potential 0 [V] of the output terminal OUT. The charge current, therefore, starts to again flow into C0 from C2 via the series branch U2 and the output terminal OUT due to the potential difference.

In association with that C0 is again charged, the electric potential of the output terminal OUT starts to increase gradually from 0 [V]. The increase in electric potential is caused due to the resonance phenomenon by U2-L and C0. If circuit constants of the inductors and the like in the first and second resonance circuits are set to be identical, therefore, the potential increase of the output terminal OUT shows a tendency similar to that in the case of the resonance phenomenon by the first resonance circuit shown at time point t0 to t1 mentioned above.

Although the electric potential of the output terminal OUT continues to rise again, it cannot rise to +V/2 [V] due to the loss by the resistance component and, at a time point when the resonance current is equal to 0, the diode U2-Di is turned off and it is clamped to an electric potential lower than +V/2 [V]. At time point t3 after the clamping, B2-SW is turned on, so that the output terminal OUT is directly connected to the power terminal V1 via B2-SW. The electric potential of the output terminal OUT, consequently, rises rapidly to +V/2 [V] as an electric potential of V1 and is clamped to the electric potential of +V/2 [V].

Subsequently, the operation at the time when the pulse waveform from the output terminal OUT trails will be described.

First, at time point t4 in the time chart shown in FIG. 20, the switches of B1-SW, U2-SW, and B2-SW which have been in the ON state so far are turned off and D2-SW is turned on. The output terminal OUT, therefore, is connected to C2 via the series branch D2 of the second resonance circuit comprising D2-L, D2-Di, and D2-SW. That is, C0 connected to the output terminal OUT is connected to C2 via the series branch D2.

As mentioned above, the charge potential of C2 is equal to +V/4 [V] and, for a period of time between time points t3 and t4, C0 has been charged to +V/2 [V]. In this case, therefore, C2 collects the charges accumulated in C0 and the resonance current due to D2-L and C2 of the second resonance circuit starts to flow in a form of discharging from C0 toward C2. Since the clamping of +V/2 [V] has been released by the turn-off of B2-SW, the electric potential of the output terminal OUT decreases gradually as shown in FIG. 20 in association with the discharge of C0.

Although the direction of the resonance current at this time is opposite to that upon rising of the electric potential mentioned above, if the circuit constants of the branches in the resonance circuit are identical, a state of the potential change shows a tendency similar to that upon rising. That is, a decrease rate of the electric potential at the time of an increase in resonance current is large and a decrease rate of the electric potential at the time of a decrease in resonance current is saturated. The electric potential of C0, that is, the electric potential of the output terminal OUT decreases over V/4 [V] as a potential difference between C0 and C2 at the start of the discharge of C0.

At time point t5 just before the electric potential of the output terminal OUT decreases to 0 [V], G2-SW is turned on and D2-SW is turned off. The output terminal OUT is, therefore, connected to the earth potential via G2-SW and G2-Di. The electric potential of the output terminal OUT decreases rapidly to the earth potential and is clamped to 0 [V].

At subsequent time point t6, D1-SW is now turned on and the output terminal OUT is connected to C1 via the series branch D1 of the first resonance circuit comprising U1-L, D1-Di, and D1-SW. As mentioned above, the charge potential of C1 is equal to −V/4 [V] and the electric potential of the output terminal OUT at time point t6, that is, the electric potential of C0 is equal to 0 [V]. The charges are, therefore, now collected from C0 to C1 and the resonance current due to U1-L and C1 of the first resonance circuit starts to flow. The electric potential of the output terminal OUT, thus, starts to decrease again from 0 [V].

At time point t7 just before the electric potential of the output terminal OUT further decreases and is equal to −V/2 [V], G1-SW is turned on and the output terminal OUT is directly connected to the power terminal V2 (−V/2 [V]). The electric potential of the output terminal OUT is, thus, clamped to −V/2 [V].

In the display panel driving circuit of FIG. 19, the operation described above is repetitively executed based on the control signals for the respective switches which are supplied from the drive control circuit 51 shown in FIG. 13. A pulse waveform shown in FIG. 20, thus, periodically appears at the output terminal OUT of the display panel driving circuit.

Figure 21:
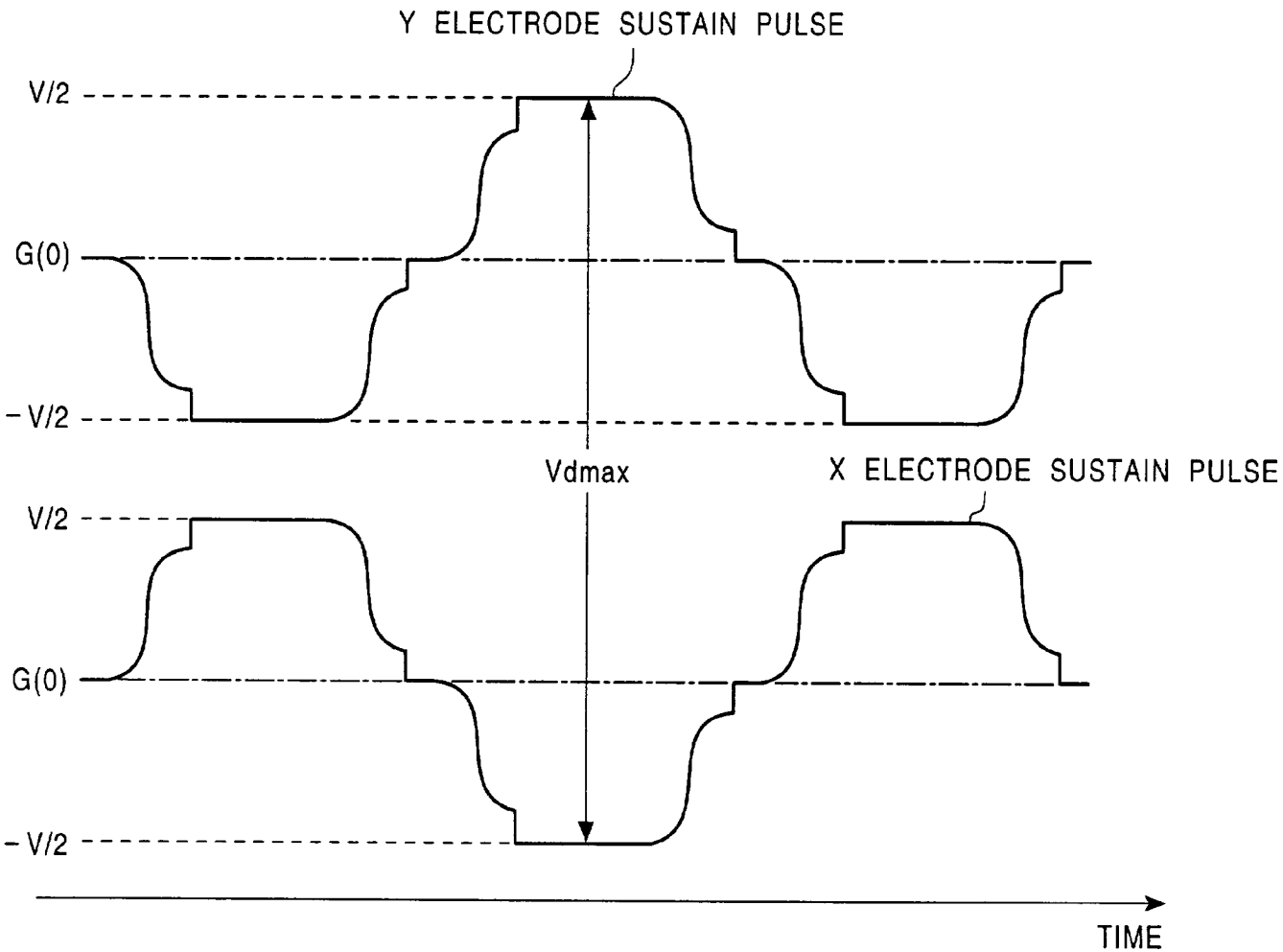
FIG. 21 is a time chart showing examples of drive pulses which are generated from the display panel driving circuit of FIG. 19.

States of pulse waveforms in the Y electrode and the X electrode in the case where the display panel driving circuit according to the embodiment is used as, for example, a generating circuit (sustain driver) of the sustain pulses $IP_y$ and $IP_x$ in the row electrode driving circuits 31 and 41 are shown in the time chart of FIG. 21.

The pulse waveform produced by the display panel driving circuit of the above embodiment has a bipolarity characteristic having an amplitude from −V/2 to +V/2. The phase of the pulse train which is supplied from each row electrode driving circuit to each electrode is controlled by the drive control circuit 51 so that a potential difference Vdmax between the Y electrode and the X electrode is equal to or higher than the discharge start voltage.

Figure 6:
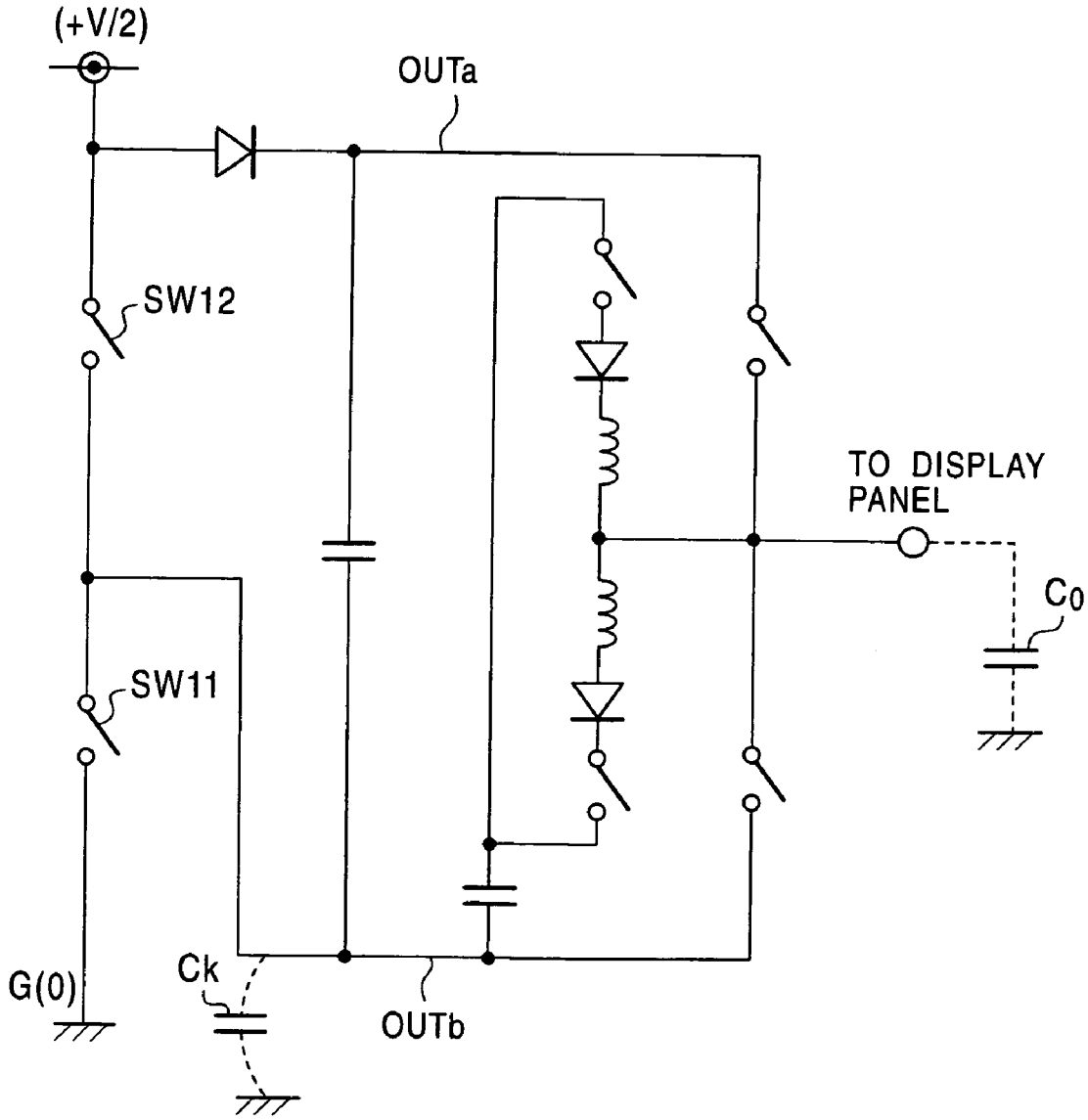
FIG. 6 PRIOR ART
FIG. 6 is a circuit diagram showing the construction of a conventional display panel driving circuit (double resonance circuit)

As described in detail above, according to the invention the potential transition circuit in the conventional double resonance circuit shown in FIG. 6 can be omitted by the use of the multistage resonance circuits which are connected. The electric power loss due to the switching devices of the potential transition circuit and the generation of the power loss associated with the excitation of the parasitic capacitance are prevented, and the electric power consumption upon driving of the display panel can be suppressed.

Although the resonance circuits of only two stages have been used in the fourth and fifth embodiments described above, the invention is not limited to those embodiments. That is, the display panel driving circuit according to the invention can be also produced by combining the resonance circuits of n stages (n≧3) of different amplitude ranges. In the case of the fifth embodiment, since the pulse waveform need to be symmetrical for the earth potential, it is necessary to set a value of (n) to an even number. By using this type of construction, the requirement of the withstanding voltages of the devices which are used can be further reduced. The optimization of the pulse waveform for the purpose of reducing the electric power consumption can be performed further finely.

In the fourth and fifth embodiments, all of the constants of the inductors and the like in each resonance circuit have been assumed to be identical in order to clarify the explanation. The invention, however, is not limited to the examples. That is, according to the invention, since the constants of the inductors and the like in the resonance circuit of each stage can be uniquely adjusted, by adjusting those values, the optimization of the pulse waveform can be finely set.

Further, if the resonance time in the pulse waveform is extended owing to the improvement of a drive sequence, by increasing the inductance of the resonance circuit, collecting efficiency of the electric power can be improved. The increase in inductance, however, results in an increase in the number of turns in the inductor, so that its DC resistance increases. Also in the case, since the multistage resonance circuit is used in the invention, the inductor can be distributed into a plurality of inductors. It is possible to easily eliminate an disadvantage such as an increase in resistance component in association with the increase in inductance.

As described in detail above, according to the invention, it is possible to provide the display panel driving circuit which can easily make an optimum design of the pulse waveform and can reduce the electric power consumption upon driving of the load.

This application is based on Japanese patent applications Nos. 2001-341086 and 2002-32402 which are herein incorporated by reference.

What is claimed is:

1. A display panel driving apparatus for driving a display panel having a row electrode group, a column electrode group arranged so as to cross said row electrode group, and capacitive light emitting devices each of which is arranged at each of crossing points of said row electrode group and said column electrode group, wherein a drive pulse is supplied to each of said capacitive light emitting devices via an output terminal when driving the display panel, said apparatus comprising:

a first parallel circuit comprising a parallel connection of a series branch constructed by a serial connection of an inductor, a switch, and a diode and a series branch constructed by a serial connection of an inductor, a switch, and a diode whose polarity is opposite to that of said diode;

a second parallel circuit having a same construction as that of said first parallel circuit;

a serial circuit comprising a serial connection of a first switch, a first diode, a second switch, a second diode, a third switch, and a fourth switch;

first, second, and third capacitors;

an output terminal for generating a pulse signal; and a DC power source having first and second electric potentials, wherein one end of said first switch is connected to said first electric potential, the other end of said first switch is connected to an anode of said first diode, one end of said first parallel circuit, and said output terminal, the other end of said first parallel circuit is connected to one end of said first capacitor, a cathode of said first diode is connected to one end of said second switch, the other end of said second switch is connected to an anode of said second diode, the other end of said first capacitor, one end of said third capacitor, and said second electric potential, a cathode of said second diode is connected to one end of said third switch, the other end of said third switch is connected to one end of said fourth switch, one end of said second parallel circuit, and said output terminal, the other end of said second parallel circuit is connected to one end of said second capacitor, the other end of said fourth switch is connected to the other end of said second capacitor, the other end of said third capacitor, and an earth potential, and ON/OFF states of each of said switches are controlled based on a control signal which is generated by a predetermined sequence, thereby generating said drive pulse onto said output terminal.

2. An apparatus according to claim 1, wherein a drain terminal and a source terminal of an FET are used as said switches and said control signal is supplied to a gate terminal of each of said FETs.

* * * * *